US008028634B2

(12) United States Patent
Miyoshi

(10) Patent No.: US 8,028,634 B2
(45) Date of Patent: Oct. 4, 2011

(54) THREADING DEVICE OF SEWING MACHINE

(75) Inventor: Takanao Miyoshi, Tokyo (JP)

(73) Assignee: Juki Corporation, Chofu-shi, Tokyo (JP)

( * ) Notice: Subject to any disclaimer, the term of this patent is extended or adjusted under 35 U.S.C. 154(b) by 386 days.

(21) Appl. No.: 12/408,999

(22) Filed: Mar. 23, 2009

(65) Prior Publication Data

US 2010/0071603 A1 Mar. 25, 2010

(30) Foreign Application Priority Data

Mar. 25, 2008 (JP) ..... P. 2008-078316

(51) Int. Cl.
*D05B 87/02* (2006.01)

(52) U.S. Cl. ..... 112/225

(58) Field of Classification Search ..... 112/225, 112/163, 165, 274, 275, 223
See application file for complete search history.

(56) References Cited

U.S. PATENT DOCUMENTS 7,568,440 B2 * 8/2009 Miyoshi ..... 112/225
7,841,283 B2 * 11/2010 Kawaguchi et al. ..... 112/221
7,905,188 B2 * 3/2011 Miyoshi ..... 112/225
7,918,171 B2 * 4/2011 Miyoshi ..... 112/225
2003/0019410 A1 * 1/2003 Sano et al. ..... 112/470.01

FOREIGN PATENT DOCUMENTS

JP 3663739 4/2005

* cited by examiner

*Primary Examiner* — Danny Worrell
(74) *Attorney, Agent, or Firm* — Drinker Biddle & Reath LLP

(57) ABSTRACT

A threading device of a sewing machine is provided. The threading device includes a threading hook which moves forward to penetrate through an eye of a needle to capture a thread and which moves backward to insert the thread into the eye, a threading shaft which holds the threading hook at a lower end thereof, a threading movement input mechanism from which an operation for causing the threading hook to carry out a threading movement is input, an up-and-down member which moves, in accordance with the operation to the threading movement input mechanism, in up and down directions to rotate the threading shaft, a thread holding mechanism which holds the thread to be inserted into the needle, and a thread releasing mechanism which releases the thread that is held by the thread holding mechanism. The thread releasing mechanism releases the thread when the threading hook is moving backward.

6 Claims, 30 Drawing Sheets

THREADING DEVICE OF SEWING MACHINE

CROSS-REFERENCE TO RELATED APPLICATION

The present application claims priority from Japanese Patent Application No. 2008-078316 filed on Mar. 25, 2008, the entire content of which is incorporated herein by reference.

FIELD OF THE INVENTION

The present invention relates to a threading device of a sewing machine.

DESCRIPTION OF RELATED ART

A related art threading device of a sewing machine includes a threading shaft which rotates to forwardly move a threading hook provided at a lower end in a threading direction, an up-and-down member which provides a rotation to the threading shaft by moving downward, a pinching section which holds a thread, and a release lever which releases, in accordance with a downward movement of the up-and-down member, the thread held by the pinching section (see, e.g., JP 3663739 B2).

The pinching section includes a thread guide plate which guides the thread to a thread holding position, a holding plate which holds the thread in cooperation with the thread guide plate, and a spring which presses the holding plate toward the thread guide plate. The holding plate is supported so as to be rotatable against the spring and with respect to the thread guide plate.

The release lever is configured to be rotatable interlockingly with the downward movement of the up-and-down member. The release lever includes, on a rotating end side, a releasing part which engages with the holding plate to rotate the holding plate.

In a threading operation, the up-and-down member is moved downward, the release lever is rotated interlockingly with the downward movement of the up-and-down member, the releasing part of the release lever is engaged with the holding plate, and the holding plate is rotated against the spring. As a result, the holding plate is opened, and the thread is released. When the up-and-down member is further moved downward, the threading hook is moved forward to penetrate through an eye of a needle to capture the thread. Thereafter, the threading hook is moved backward to pull the thread into the eye of the needle.

In the threading device described above, however, the thread is released immediately after the up-and-down member starts the downward movement. That is, the thread is released before the threading hook penetrates through the eye of the needle to capture the thread. Thus, there is a possibility of a situation in which the thread is moved away from a moving path of the threading hook so that the threading hook cannot capture the thread and the threading operation cannot be reliably carried out.

Further, the threading device described above is configured such that the release lever rotates the holding plate by interlocking with the up-and-down member via a moving base. That is, the threading device includes a large number of components and has a complicated mechanism. Accordingly, an operation failure is likely to occur, and a cost of the device is high.

Furthermore, it is difficult for an operator to visually check a pinched condition of the thread.

SUMMARY OF THE INVENTION

Illustrative aspects of the present invention provide a threading device which can suitably carry out a threading operation.

According to an illustrative aspect of the present invention, a threading device of a sewing machine is provided. The threading device includes a threading hook which moves forward to penetrate through an eye of a needle to capture a thread and which moves backward to insert the thread into the eye, a threading shaft which holds the threading hook at a lower end thereof, a threading movement input mechanism from which an operation for causing the threading hook to carry out a threading movement is input, an up-and-down member which moves, in accordance with the operation to the threading movement input mechanism, in up and down directions to rotate the threading shaft, a thread holding mechanism which holds the thread to be inserted into the needle by pinching the thread with a pinching section which is biased by a first elastic member, and a thread releasing mechanism which releases the thread that is held by the thread holding mechanism. The thread releasing mechanism releases the thread when the threading hook is moving backward.

According to another illustrative aspect of the present invention, a threading device of a sewing machine is provided. The threading device includes a threading hook which moves forward to penetrate through an eye of a needle to capture a thread and which moves backward to insert the thread into the eye, thread holding means for holding the thread such that the thread extends in front of the eye of the needle, and thread releasing means for releasing, when the threading hook is moving backward, the thread that is held by the thread holding means.

Other aspects and advantages of the present invention will be apparent from the following description, the drawings and the claims.

DETAILED DESCRIPTION

Hereinafter, embodiments of the present invention will be described with reference to the drawings. The following embodiments do not limit the scope of the present invention.

A threading device 10 according to an embodiment of the present invention will be described with reference to FIGS. 1 to 23D.

Overall Configuration of Threading Device of Sewing Machine

Figure 1:
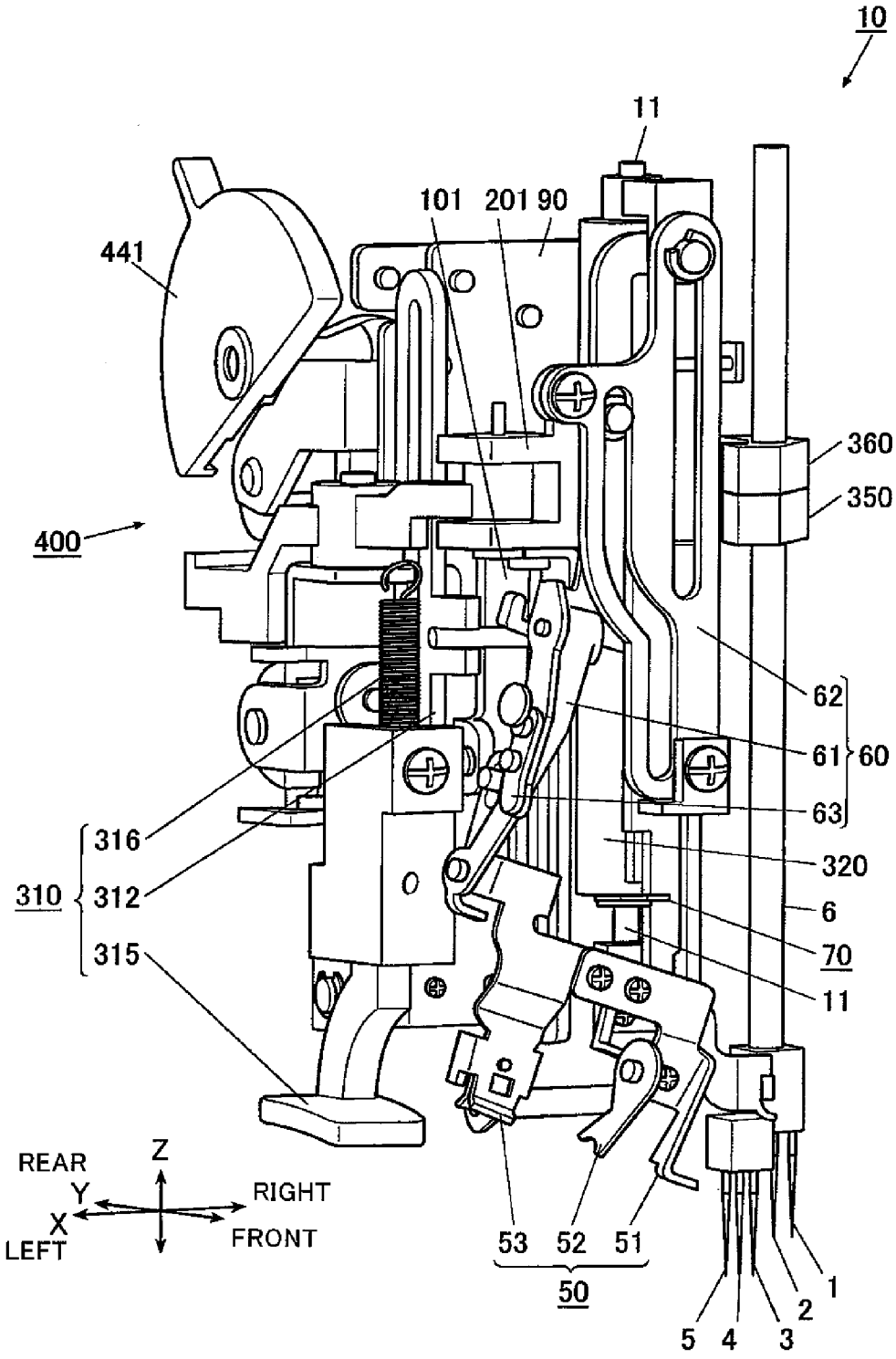
FIG. 1 is a perspective view of a threading device according to an embodiment of the invention.
Figure 2:
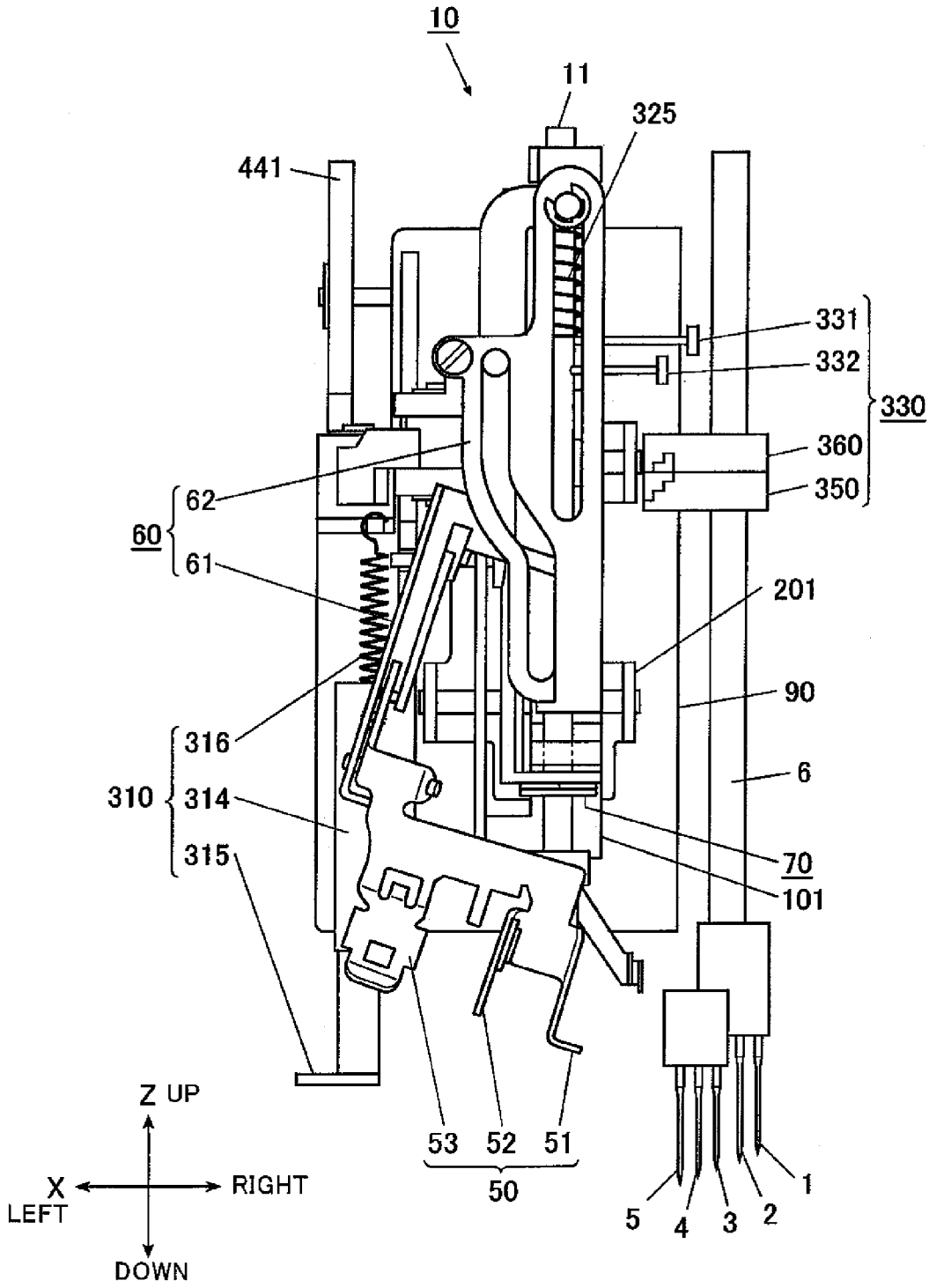
FIG. 2 is a front view of the threading device.
Figure 3:
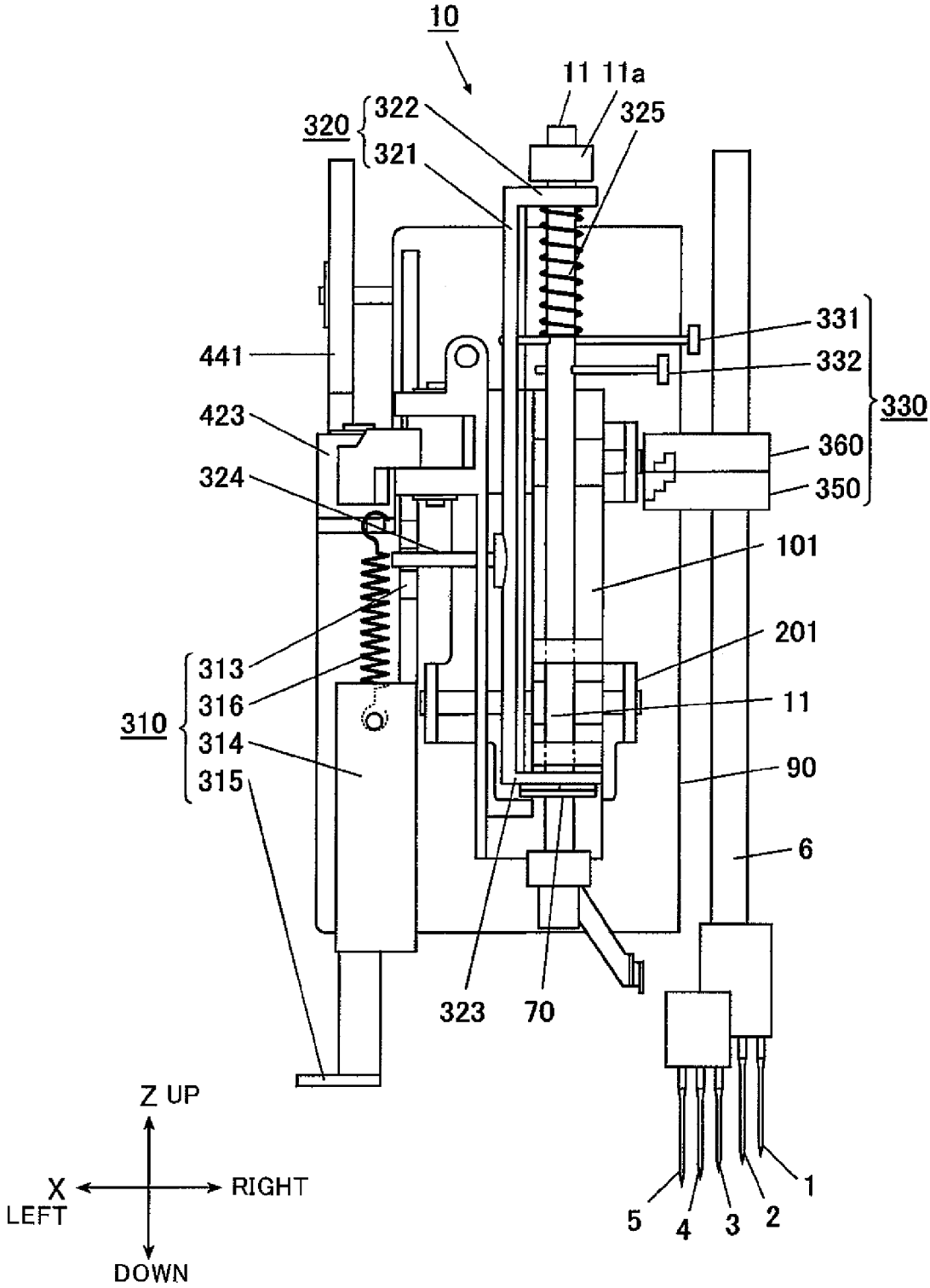
FIG. 3 is a schematic front view of the threading device.

As shown in FIGS. 1 to 3, a sewing machine, on which the threading device 10 is mounted, includes five needles 1 to 5, and can implement both overlock stitching and cover stitching. When seen in a top view, a set of needles 1, 2 to be used for the overlock stitching are arranged in a row, and another set of needles 3, 4, 5 to be used for the cover stitching are arranged in another row. The set of needles 1, 2 and the set of needles 3, 4, 5 are arranged in parallel rows and are disposed at an interval in a direction orthogonal to the direction of the rows. The needles 1 to 5 are held by a single needle bar 6.

In the following description, a Z-axis direction is a direction parallel to the needle bar 6, an X-axis direction is a direction which is orthogonal to the needle bar 6 and is the direction of the row of the set of needles 1, 2 or the set of needles 3, 4, 5, and a Y-axis direction is a direction orthogonal to the X-axis direction and the Z-axis direction.

The threading device 10 is mounted on a surface portion of the sewing machine, and is disposed adjacently to the needle bar 6. The threading device 10 includes a threading hook 20 which moves forward to enter an eye of one of the needles 1 to 5 to capture a thread and which moves backward to insert the thread into the eye, a threading shaft 11 which holds the threading hook 20, a threading movement input mechanism 300 which provides a back-and-forth movement to the threading hook 20 via the threading shaft 11, a thread holding mechanism 50 which holds the thread on an opposite side of the threading hook 20 with respect to the needles 1 to 5, a support mechanism 60 which supports the thread holding mechanism 50 such that the thread holding mechanism 50 is movable between a threading position which is on the opposite side of the threading hook 20 with respect to the needles 1 to 5 and a standby position which is away from the needles 1 to 5, a thread releasing mechanism 70 which releases the thread from the thread holding mechanism 50 in accordance with the backward movement of the threading hook 20, a first support mechanism 100 which supports the threading shaft 11 such that the threading shaft 11 is movable in the X-axis direction, a second support mechanism 200 which supports the threading shaft 11 such that the threading shaft 11 is movable in the Y-axis direction, a positioning mechanism 400 which moves the threading shaft 11 along a path corresponding to an arrangement of the needles 1 to 5, and a frame 90 which supports the respective structures.

Threading Shaft and Threading Hook

As shown in FIGS. 1 to 5, the threading shaft 11 has a shape of a round rod, and is arranged near the needle bar 6 and along the Z-axis direction, parallel to the needle bar 6.

Figure 5:
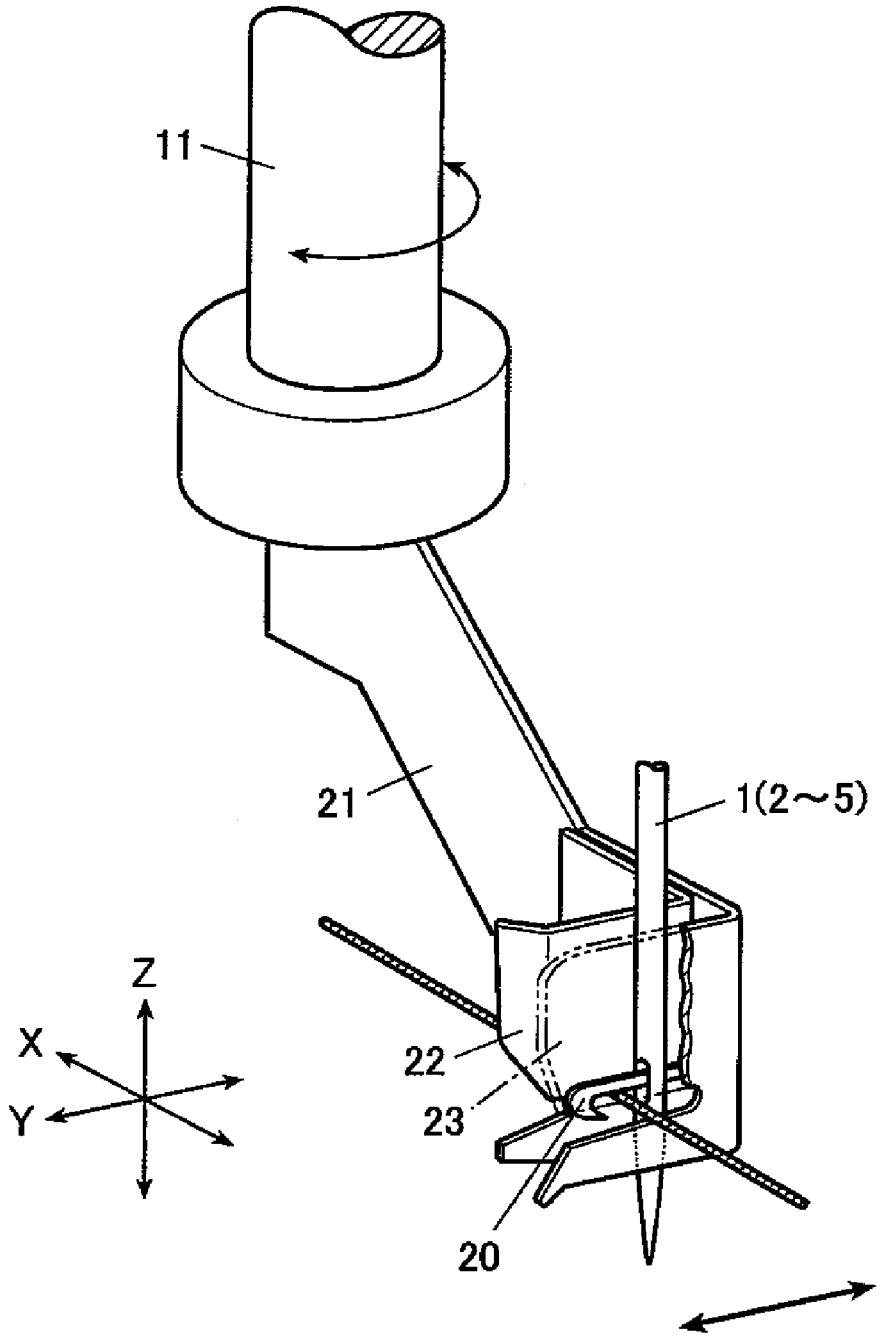
FIG. 5 is an enlarged perspective view of a lower end portion of a threading shaft.

As shown in FIG. 5, the threading hook 20 is attached to a lower end portion of the threading shaft 11 via a hook holding arm 21. The hook holding arm 21 is extended downward in a radial direction of a circle having a center at the threading shaft 11.

The threading hook 20 is attached to a distal end part of the hook holding awl 21, and is extended in a tangential direction of the circle having the center at the threading shaft 11. The threading hook 20 moves forward, with a distal end part of the threading hook 20 directed forward, in accordance with a forward rotation of the threading shaft 11, and moves backward in accordance with a reverse rotation of the threading shaft 11. A hook-shaped barb is formed on the distal end part of the threading hook 20. The threading hook 20 carries out a threading operation by being inserted from the distal end part into the eye of one of the needles 1 to 5 to capture the thread with the barb during the forward movement, and by pulling the thread into the eye during the backward movement.

A pair of guide plates 22, 23 is provided at the distal end part of the hook holding arm 21 and on respective sides of the threading hook 20. Plate surfaces of the guide plates 22, 23 are substantially parallel to the threading hook 20 and the threading shaft 11. A distance between the guide plates 22, 23 is slightly larger than a thickness of the needle. The guide plates 22, 23 are curved such that the distance therebetween is increased toward the distal end. During the forward movement of the threading hook 20, the guide plates 22, 23 guide the eye of one of the needles 1 to 5 to the threading hook 20.

Further, each of the guide plates 22, 23 is formed with a thread guiding cutout along a direction in which the threading hook 20 extends and at a location slightly lower than the threading hook 20, thereby, during the forward movement of the threading hook 20, guiding the thread to be at a suitable height allowing the threading hook 20 to capture the thread.

Frame

Figure 4:
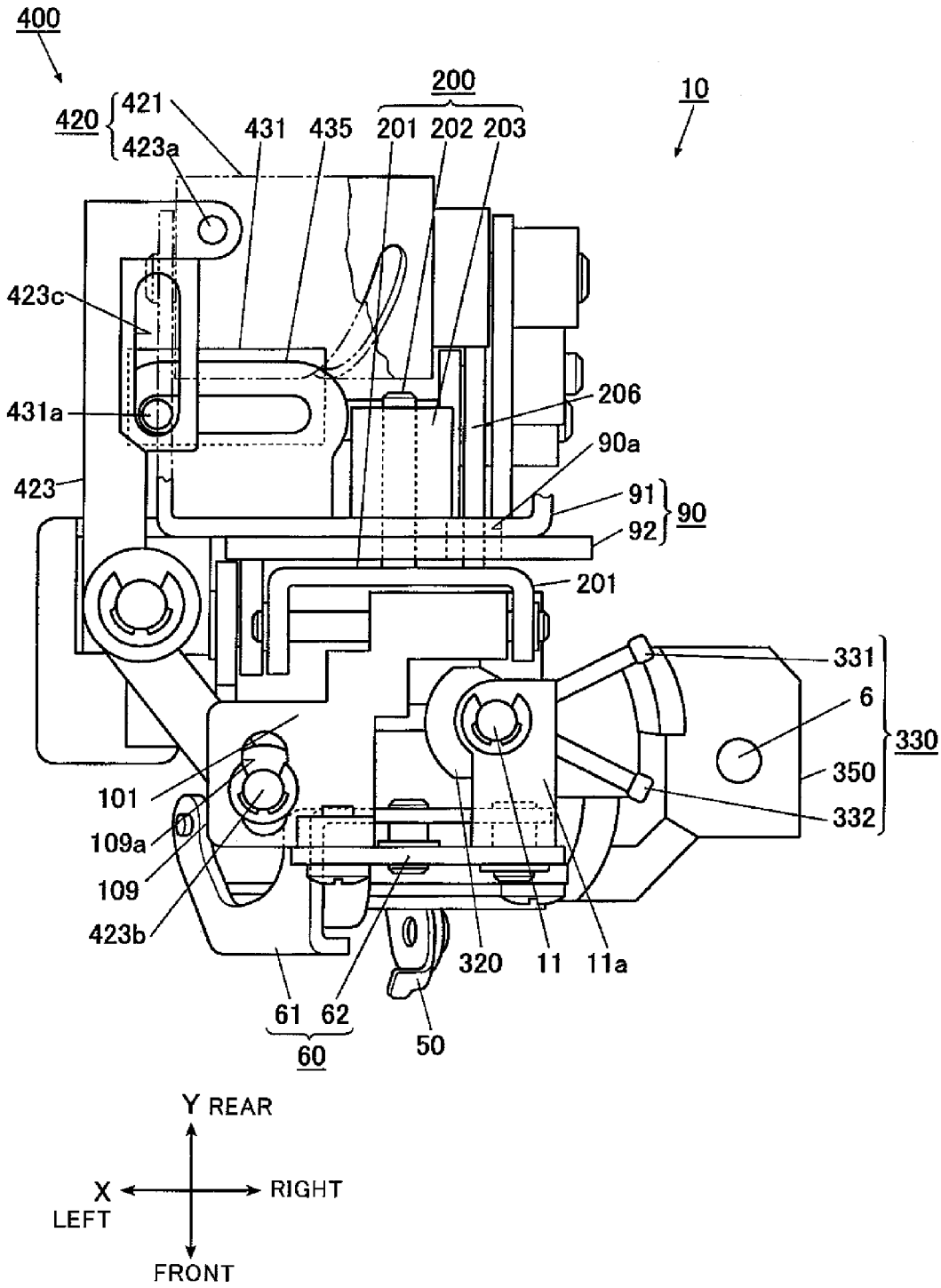
FIG. 4 is a schematic top view of the threading device.
Figure 6:
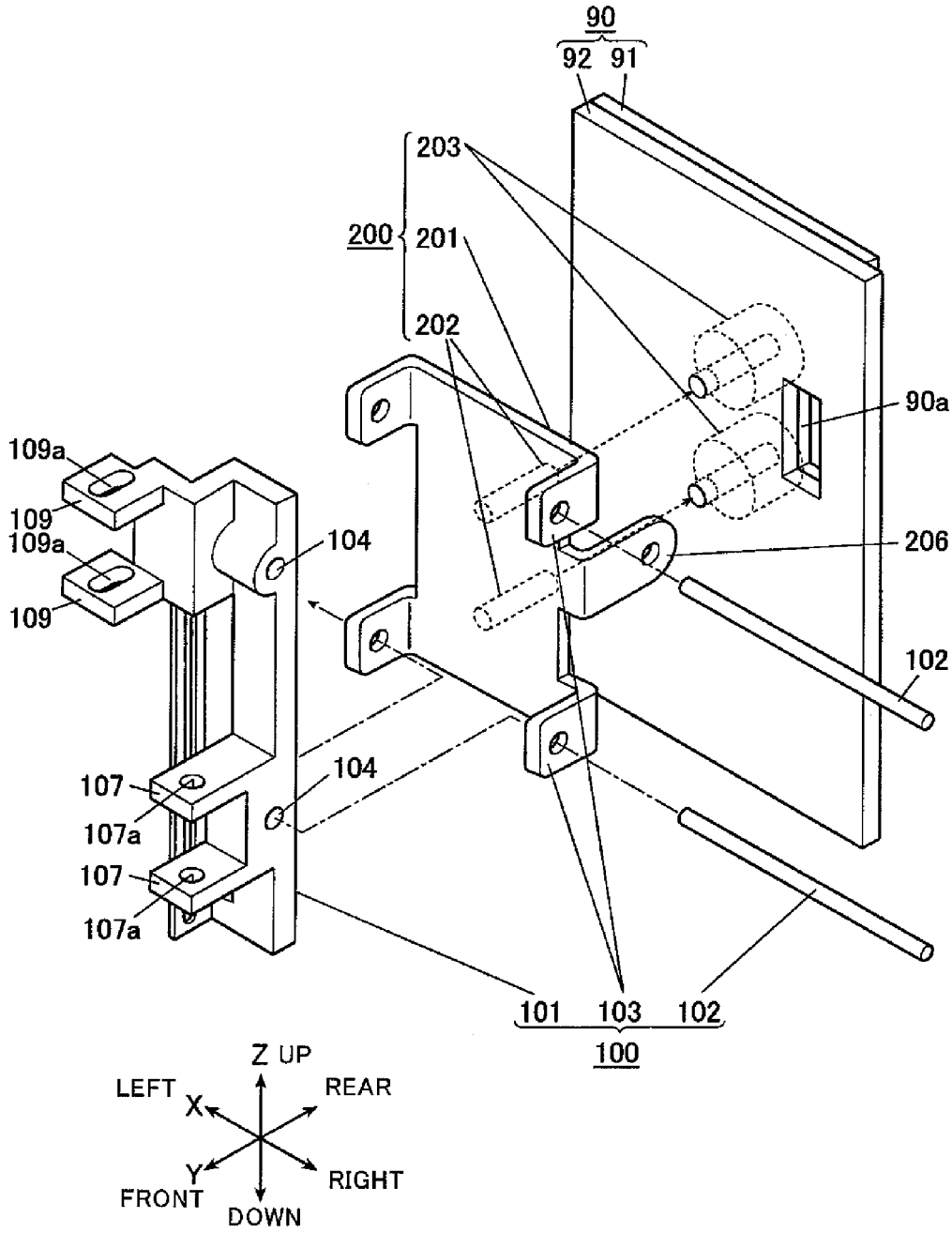
FIG. 6 is a perspective view schematically showing a supporting structure between a frame, a first support mechanism and a second support mechanism.
Figure 7:
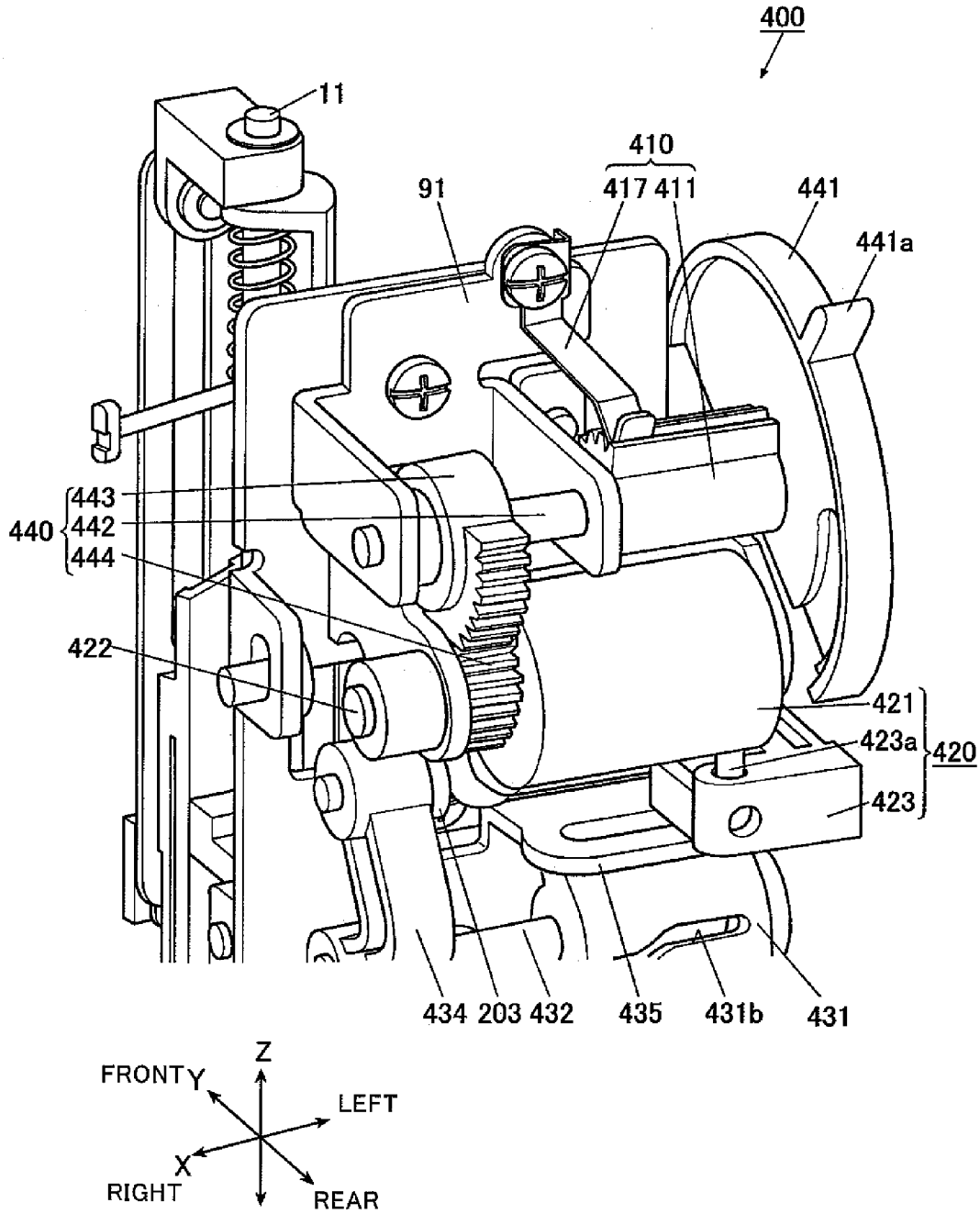
FIG. 7 is another perspective view of the threading device.

As shown in FIGS. 1, 4 and 6, the frame 90 is formed by a sheet metal processing, and is fixed to a sewing machine frame (not shown). The frame 90 includes a planar back plate 91 and a front frame member 92 which are fixedly coupled.

The back plate 91 is fixedly supported on the sewing machine frame such that a plate surface extends along an X-Z plane. The back plate 91 holds the positioning mechanism 400 at a rear side thereof.

The front frame member 92 is arranged along the X-Z plane in close contact with a front side of the back plate 91. The second support mechanism 200 is arranged on a front side of the front frame member 92, and the first support mechanism 100 is arranged on a front side of the second support mechanism 200.

Second Support Mechanism

As shown in FIGS. 4 and 6, the second support mechanism 200 includes a second frame member 201 which is formed by a sheet metal processing, a pair of guide shafts 202 which is projected in the Y-axis direction from a rear face of the second frame member 201, and a pair of cylindrical support portions 203 which supports the guide shafts 202. The cylindrical support portion 203 is provided on the frame 90.

Each of the guide shafts 202 is slidably inserted into the corresponding cylindrical support portion 203. That is, the second frame member 201 and all of structures supported by the second frame member 201 are movable in the Y-axis direction with respect to the frame 90.

The second frame member 201 includes a movement transmitting aim 206 extending in the Y-axis direction toward a rear of the second frame member 201. The movement transmitting arm 206 extends toward a rear than the back plate 91 through a through hole 90*a* provided in the frame 90, and a distal end part thereof is coupled to the positioning mechanism 400. That is, a moving force in the Y-axis direction is input from the movement transmitting arm 206 to the second frame member 201.

First Support Mechanism

As shown in FIGS. 3, 4 and 6, the first support mechanism 100 includes a first frame member 101 which is supported so as to be movable in the X-axis direction with respect to the second frame member 201 of the second support mechanism 200, a pair of guide shafts 102 coupling the first frame member 101 to the second frame member 201, and two pairs of support arm portions 103 provided on the second frame member 201 and serving to support the guide shaft 102.

Two support brackets 107 are arranged next to each other in an up-and-down direction and on a lower part on a front side of the first frame member 101. Each of the support brackets 107 is formed along an X-Y plane. Each of the support brackets 107 is formed with an insertion hole 107*a* through which the threading shaft 11 is inserted in the Z-axis direction. By inserting the threading shaft 11 into the through hole 107*a*, the first frame member 101 supports the threading shaft 11 so as to be movable in the up-and-down direction.

A guide hole 104 along the Y-axis direction is form in each of upper and lower parts of the first frame member 101 near a rear face of the first frame member 101. On the other hand, the support arm portions 103 are formed on right and left ends of each of the upper and lower parts of the second frame member 201 by bending along a Y-Z plane, and each of the right and left pairs holds the corresponding one of the guide shaft 102 in the X-axis direction. The first frame member 101 is supported on each of the support arm portions 103 of the second frame member 201 by inserting each of the guide shafts 102 into the corresponding guide hole 104. According to this structure, the first frame member 101 is slidable in the X-axis direction along the guide shaft 102 with respect to the second frame member 201. That is, the first frame member 101 and all of the structures supported by the first frame member 101 are movable in the X-axis direction with respect to the second frame member 201. Consequently, due to the cooperation of the first support mechanism 100 and the second support mechanism 200, all of the structures supported by the first frame member 101 are movable in the X-axis direction and in Y-axis direction with respect to the frame 90.

As shown in FIGS. 4 and 6, moreover, a pair of upper and lower movement transmitting brackets 109 is extended along the X-Y plane from a left upper part of the first frame member 101. A swinging arm 423 of the positioning mechanism 400 is coupled between the respective motion transmitting brackets 109 through a support shaft 423*b* extending in the Z-axis direction. That is, a moving force in the X-axis direction is input from the movement transmitting brackets 109 to the first frame member 101.

Positioning Mechanism

The positioning mechanism 400 will be described with reference to FIGS. 4, 7, 8, 9, 10A and 10B.

Each structure of the positioning mechanism 400 is mainly supported on the rear side of the back plate 91 of the frame 90. The positioning mechanism 400 includes a dial 441, an operation input section 440 through which a operation from the dial 441 to switch the position of the threading shaft 11 to each of the needles 1 to 5 is sequentially input, a stepwise switching portion 410 which intermittently sections the rotating operation of the dial 441 in order to implement a stepwise switching operation for each of the needles 1 to 5, a first cam mechanism 420 which provides a movement in the X-axis direction to the threading shaft 11 in accordance with the operation of the dial 441, and a second cam mechanism 430 which provides a movement in the Y-axis direction to the threading shaft 11 in accordance with the operation of the dial 441.

Operation Input Section and Stepwise Switching Portion

The operation input section 440 includes a first rotating shaft 442 which is rotatably supported along the X-axis direction at an upper part of the rear side of the back plate 91, a driving gear 443 which is fixed to a right end of the first rotating shaft 442, and a driven gear 444 which is fixed to a second rotating shaft 422 of the first cam mechanism 420.

The dial 441 has such a shape that a part of a disc is linearly cut away. The dial 441 has a tab 441*a* which extends outward in a radial direction of the disc shape. The dial 441 is fixed to a left end of the first rotating shaft 442 at a central position of the disc shape.

The driving gear 443 is meshed with the driven gear 444. When the dial 441 is rotated, the driving gear 443 transmits a rotating torque to the second rotating shaft 422 through the driven gear 444 to actuate the first cam mechanism 420.

The dial 441 is arranged at a rightward and rearward part of the sewing machine frame such that the tab 441*a* protrudes out from a rear side of a sewing machine cover.

Figure 9:
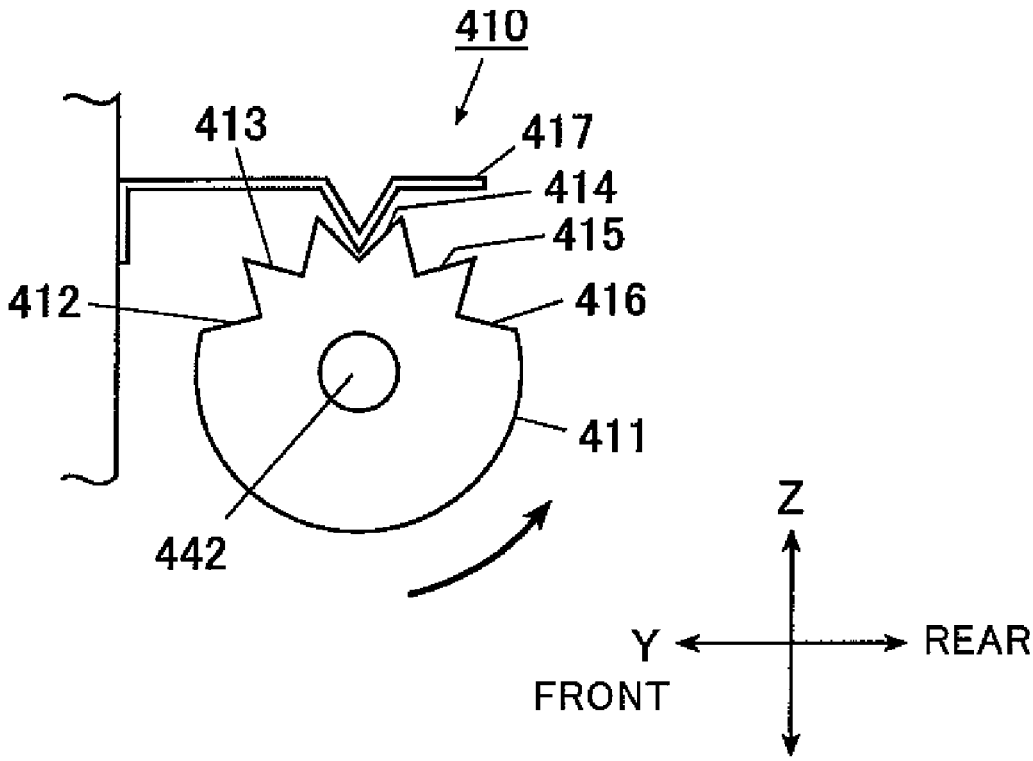
FIG. 9 is a right side view of a stepwise switching portion of a dial.

The stepwise switching portion 410 includes a rotating body 411 which is fixedly supported onto an intermediate part of the first rotating shaft 442, and a plate spring 417. As shown in FIG. 9, the rotating body 411 has, on an outer circumference thereof, engaging concave portions 412 to 416 which individually correspond to the respective needles 1 to 5. The plate spring 417 engages with one of the engaging concave portions 412 to 416 to regulate a rotation of the rotating body 411.

More specifically, an engaging projection is formed on a distal end part of the plate spring 417. The plate spring 417 is attached to the back plate 91 in a state in which the engaging projection is biased to press the rotating body 411. When the dial 441 is rotated, therefore, the engaging projection sequentially enters the engaging concave portions 412 to 416 and regulates the rotation of the dial 441 each time. That is, the rotating operation is carried out intermittently. An angular interval between each of the engaging concave portions 412 to 416 is set such that a rotating amount between each of the engaging concave portions 412 to 416 corresponds to an operation amount required for moving the threading shaft 11 between the respective needles 1 to 5.

First Cam Mechanism

The first cam mechanism 420 includes the second rotating shaft 422 which is supported on the rear side of the back plate 91 so as to be rotatable about the X-axis direction, a first cam 421 which is supported so as to be rotated together with the second rotating shaft 422, and the swinging arm 423. A cam groove 421*a* is formed in an outer circumference of the first cam 421, and the swinging arm 423 has a projection 423*a* which is a cam follower engaging with the cam groove 421*a*.

Figure 8:
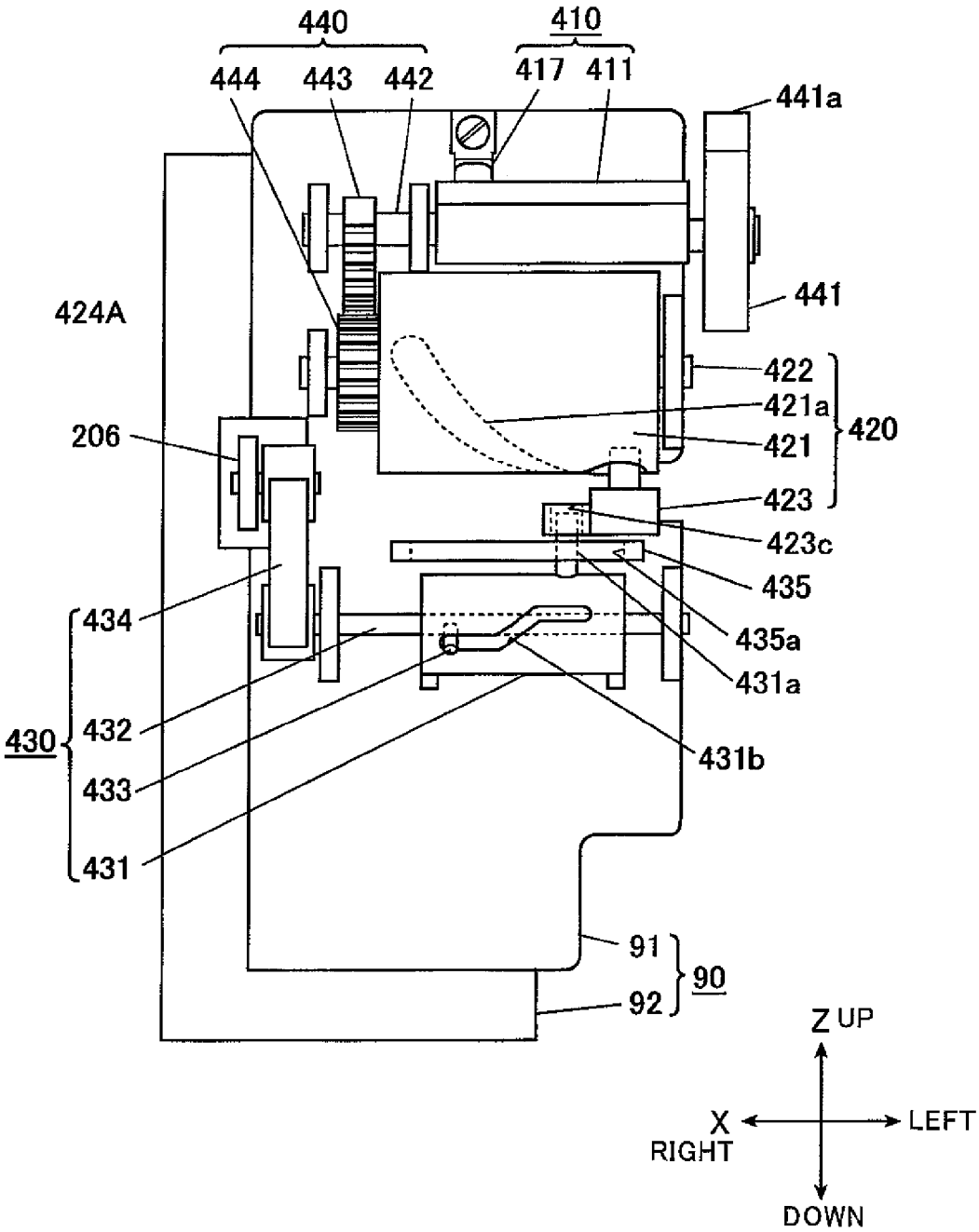
FIG. 8 is a schematic rear view of the threading device.

The first cam 421 has a cylindrical shape. The cam groove 421*a* is spirally formed in the outer circumferential surface of the first cam 421. FIG. 8 shows a state in which the projection 423*a* is positioned on one end of the cam groove 421*a* and, in this state, the threading hook 20 can insert the thread into the needle 1.

The swinging arm 423 is coupled to the movement transmitting brackets 109 of the first frame member 101 via the support shaft 423*b* which is provided on a front end part thereof. As described above, each of the movement transmitting brackets 109 is formed with a slot 109*a* along the in the Y-axis direction, and the support shaft 423*b* of the swinging arm 423 is inserted in the slots 109*a*.

When the first cam 421 is rotated in a clockwise direction in a left side view, a moving force in the X-axis direction (a rightward direction) is provided to the projection 423*a* of the swinging arm 423. Accordingly, the front end part of the swinging arm 423 is moved leftward, and the first frame member 101 is moved in a leftward direction via the movement transmitting brackets 109. When the first cam 421 is rotated in a reverse direction, the first frame member 101 is moved in the rightward direction.

The slots 109*a* of the movement transmitting brackets 109 are configured to permit a displacement in the Y-axis direction which is generated during the rotation of the front end part of the swinging arm 423, and to permit a movement of the first frame member 101 in the Y-axis direction in accordance with the movement of the second frame member 201 in the Y-axis direction due to the second cam mechanism 430.

Second Cam Mechanism

The second cam mechanism 430 includes a second cam 431 which moves in the X-axis direction together with a swinging motion of the swinging arm 423, a third rotating shaft 432 which is supported on the rear side of the back plate 91 so as to be rotatable about the X-axis direction, a follower projection 433 which is provided on the rotating shaft 432 to convert a linear movement of the second cam 431 into a rotating movement and to transmit the rotating movement to the third rotating shaft 432, and an L-shaped link member 434 which provides a movement in the Y-axis direction to the second frame member 201 via the movement transmitting arm 206 in accordance with the rotation of the third rotating shaft 432.

The second cam 431 has such a shape that a part of an outer circumferential surface of a hollow cylinder is cut away. The third rotating shaft 432 is inserted inside the second cam 431. The second cam 431 is supported by the third rotating shaft 432 so as to be slidable in the X-axis direction.

An engaging projection 431*a* is provided on an outer circumferential surface of the second cam 431 to protrude outward. The front end part of the swinging arm 423 is formed with a slot 423*c* along a longitudinal direction of the swinging arm 423. The engaging projection 431*a* is inserted into the slot 423*c*. Accordingly, when the swinging arm 423 is swung in accordance with the rotation of the first cam 421, the second cam 431 is moved in the X-axis direction. As shown in FIG. 8, a whirl stop 435 is disposed between the second cam 431 and the swinging arm 423. A slot 435*a* along the X-axis direction is formed through the whirl stop 435. The engaging projection 431*a* is inserted into the slot 435*a* so that the movement of the engaging projection 431*a* in the Y-axis direction is regulated to prevent the rotation of the second cam 431.

A slot 431*b* along the X-axis direction is formed on the outer circumferential surface of the second cam 431. A tip part of the follower projection 433 is inserted into the slot 431*b*. The slot 431*b* has an inclined section in an intermediate portion thereof. When the second cam 431 is slid along the third rotating shaft 432 so that the follower projection 433 approaches the inclined section of the slot 431*b*, the follower projection 433 is moved in a circumferential direction to rotate the third rotating shaft 432.

The link member 434 is supported on the third rotating shaft 432, and is rotated together with the third rotating shaft 432. The link member 434 is provided to extend in the Z-axis direction, and has a rotating end coupled to the power transmitting aim 206 extending from the second frame member 201. Therefore, when the third rotating shaft 432 and the link member 434 are rotated due to the linear movement of the second cam 431, a moving force in the Y-axis direction is provided to the power transmitting arm 206 so that the second frame member 201 and the first frame member 101 are moved in the Y-axis direction.

Operation of Positioning Mechanism

Next, with reference to FIG. 10, description will be given to a moved state of the followers which is given from the respective cams 421, 431 through a five-step switching of the dial 441.

Figure 10A:
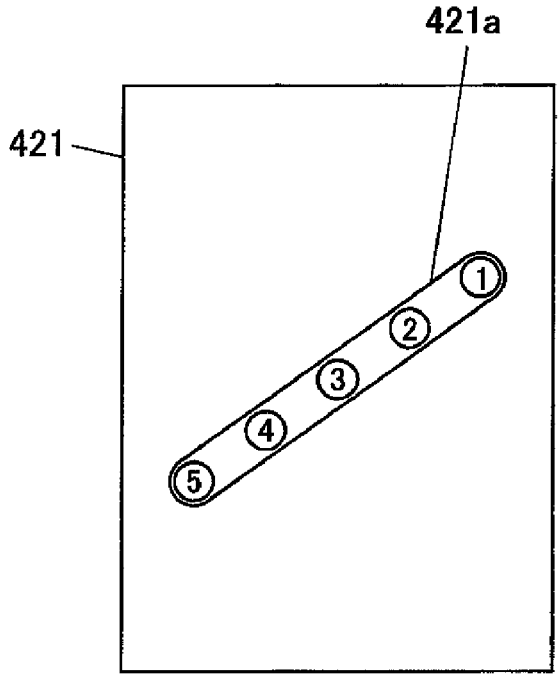
FIG. 10A is a developed view of a first cam.
Figure 10B:
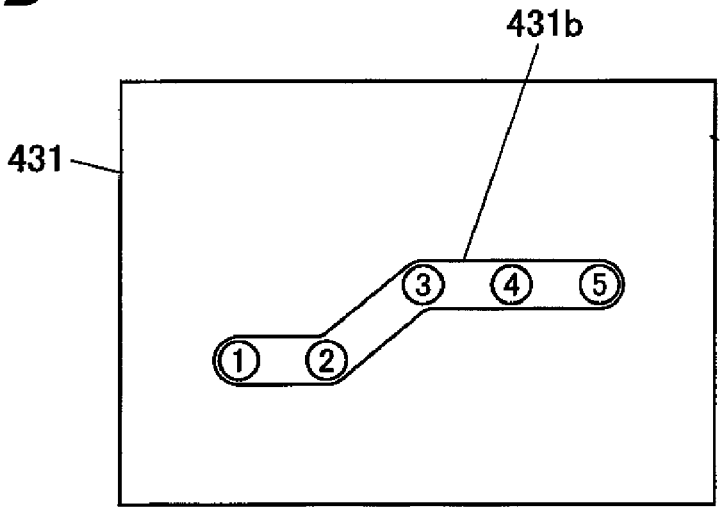
FIG. 10B is a developed view of a second cam.

(1) A state in which the dial 441 is turned to a position at which the engaging projection of the plate spring 417 is engaged with the engaging concave portion 412 will be referred to as a first state. As shown in FIG. 10A, in the first state, the projection 423*a* is placed in a first position which is one end of the cam groove 421*a* of the first cam 421, and the first frame member 101 is placed in a rightmost position. On the other hand, as shown in FIG. 10B, in the first state, the projection 433 is placed in a first position which is one end of the slot 431*b* of the second cam 431, and the second frame member 201 is placed in a rearmost position. By this arrangement of the first and second frame members 101, 201, the threading shaft 11 is placed in a position at which the threading hook 20 inserts the thread into the needle 1.

(2) A state in which the dial 441 is turned to a position at which the engaging projection of the plate spring 417 is engaged with the engaging concave portion 413 will be referred to as a second state. As shown in FIG. 10A, in the second state, the projection 423*a* is placed in a second position of the cam groove 421*a* of the first cam 421, and the first frame member 101 is moved leftward. On the other hand, as shown in FIG. 10B, in the second state, the projection 433 is placed in a second position of the slot 431*b* of the second cam 431, and the second frame member 201 is not moved from the first state. At this time, a moving distance of the first frame member 101 is coincident with a distance between the needles 1, 2 in the X-axis direction. By this arrangement of the first and second frame members 101, 201, the threading shaft 11 is placed in a position at which the threading hook 20 inserts the thread into the needle 2.

(3) A state in which the dial 441 is turned to a position at which the engaging projection of the plate spring 417 is engaged with the engaging concave portion 414 will be referred to as a third state. As shown in FIG. 10A, in the third state, the projection 423*a* is placed in a third position of the cam groove 421*a* of the first cam 421, and the first frame member 101 is moved leftward. On the other hand, as shown in FIG. 10B, in the third state, the projection 433 is placed in a third position of the slot 431*b* of the second cam 431, and the second frame member 201 is moved to the front. At this time, the moving distance of the first frame member 101 is coincident with a distance between the needles 2, 3 in the X-axis direction, and a moving distance of the second frame member 201 is coincident with a distance between the needles 2, 3 in the Y-axis direction. By this arrangement of the first and second frame members 101, 201, accordingly, the threading shaft 11 is placed in a position at which the threading hook 20 inserts the thread into the needle 3.

(4) A state in which the dial 441 is turned to a position at which the engaging projection of the plate spring 417 is engaged with the engaging concave portion 415 will be referred to as a fourth state. As shown in FIG. 10A, in the fourth state, the projection 423*a* is placed in a fourth position of the cam groove 421*a* of the cam 421, and the first frame member 101 is moved leftward. On the other hand, as shown in FIG. 10B, in the fourth state, the projection 433 is placed in a fourth position of the slot 431*b* of the second cam 431, and the second frame member 201 is not moved from the third state. At this time, the moving distance of the first frame member 101 is coincident with a distance between the needles 3, 4 in the X-axis direction. By this arrangement of the third and second frame members 101, 201, the threading shaft 11 is placed in a position at which the threading hook 20 inserts the thread into the needle 4.

(5) A state in which the dial 441 is turned to a position at which the engaging projection of the plate spring 417 is engaged with the engaging concave portion 416 will be referred to as a fifth state. As shown in FIG. 10A, in the fifth state, the projection 423*a* is placed in a fifth position of the cam groove 421*a* of the first cam 421, and the first frame member 101 is moved leftward. On the other hand, as shown in FIG. 10B, in the fifth state, the projection 433 is placed in a fifth position of the slot 431*b* of the second cam 431, and the second frame member 201 is not moved from the third state. At this time, the moving distance of the first frame member 101 is coincident with a distance between the needles 4, 5 in the X-axis direction. By this arrangement of the first and second frame members 101, 201, the threading shaft 11 is placed in a position at which the threading hook 20 inserts the thread into the needle 5.

As described above, in accordance with a sequential position switching operation of the dial 441 from the first state to the fifth state, the threading shaft 11 is placed at each of the positions at which the threading hook 20 can insert the thread into the respective needles 1 to 5.

Threading Movement Input Mechanism

The threading movement input mechanism 300 will be described with reference to FIGS. 2, 3 and 11 to 15.

The threading movement input mechanism 300 includes an operation lever 310 downwardly moves the threading shaft 11 to input a threading movement, a slide guide 320 (an up-and-down member) which moves down together with the threading shaft 11 in accordance with a downward input operation from the operation lever 310, a height regulating mechanism 330 which stops the downwardly moving threading shaft 11 at a plurality of heights corresponding to heights of the eyes of the respective needles 1 to 5, and a threading cam mechanism 340 which rotates, when only the slide guide 320 is moved downward with respect to the threading shaft 11, the threading shaft 11 in a direction in which the threading hook 20 moves forward.

Slide Guide

The slide guide 320 includes a back plate 321 which extends in the up-and-down direction and has an arcuate section, support portions 322, 323 which are provided integrally with upper and lower ends of the back plate 321, and an engaging shaft 324 which extends leftward in the X-axis direction from the back plate 321 and engages with the operation lever 310.

Each of the support portions 322, 323 has a shape of a plate along the X-Y plane, and has a through hole into which the threading shaft 11 is inserted. The slide guide 320 is coupled to the threading shaft 11 via the through holes so as to be slidable along the threading shaft 11. A compression coil spring 325 is inserted between the upper support portion 322 and a first guide pin 331 which is provided on the threading shaft 11. A stopper 11*a* is provided on an upper end part of the threading shaft 11, and contacts on an upper surface of the support portion 322. Accordingly, the compression coil spring 325 biases the threading shaft 11 downward with respect to the slide guide 320, and biases the slide guide 320 upward with respect to the threading shaft 11.

Operation Lever

Figure 11:
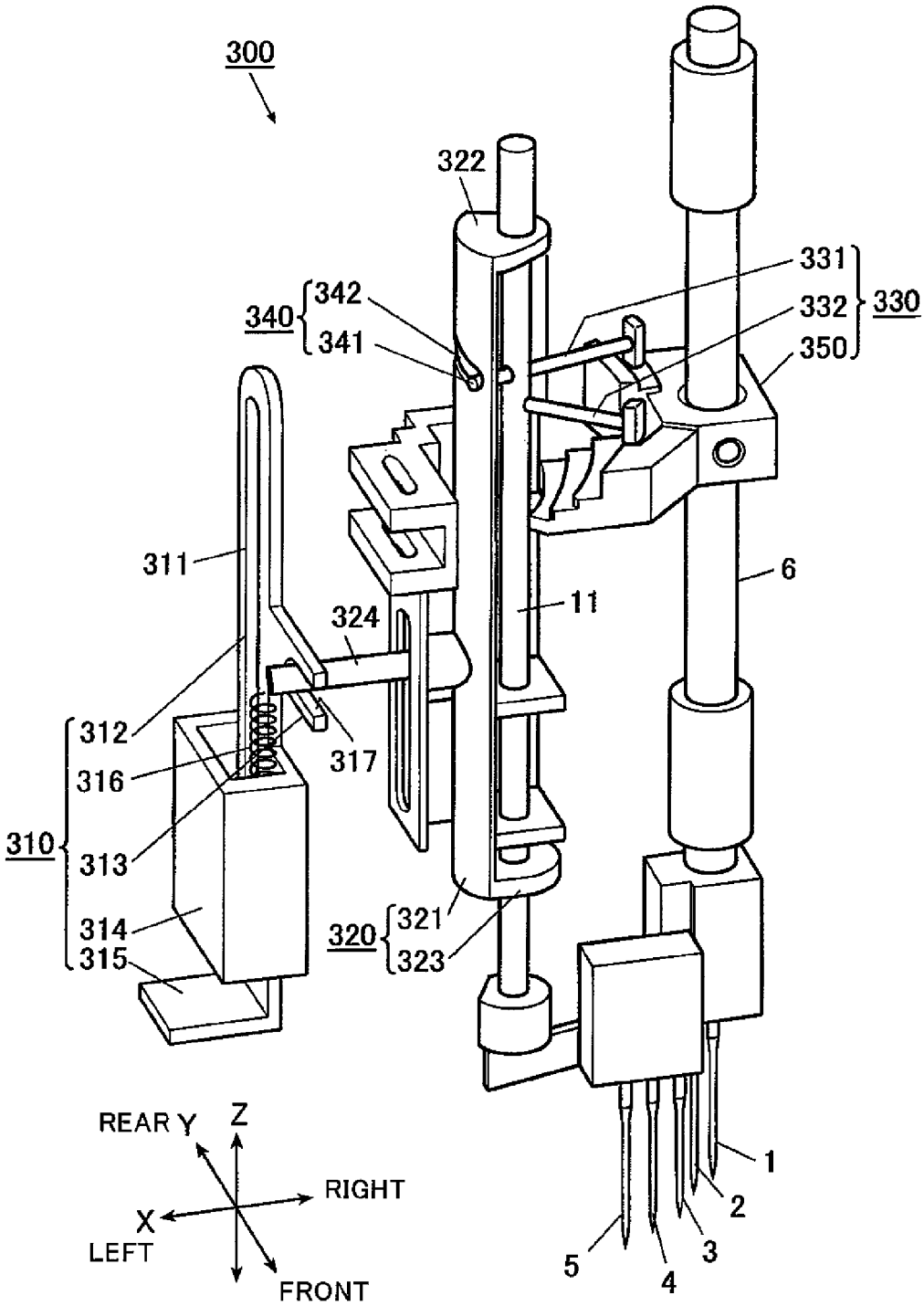
FIG. 11 is a perspective view of a threading movement input mechanism.

As shown in FIGS. 3 and 11, the operation lever 310 is supported on a bracket (not shown) which is protruded from the front frame member 92 of the frame 90 toward the front. The bracket has a shape of a plate along the Y-Z plane, and includes two guide shafts which are protruded leftward. The operation lever 310 is formed with a slot 311 which extends in the up-and-down direction and into which the guide shafts of the bracket are inserted. A C-ring is provided on a tip part of each of the guide shafts so that the operation lever 310 is held so as not to slip from the guide shafts. By this arrangement, the operation lever 310 is supported so as to be movable in the up-and-down direction with respect to the frame 90.

The operation lever 310 includes a body portion 312 extending in the up-and-down direction, an arm portion 313 extending in the Y-axis direction from an intermediate part of the body portion 312, and a box-shaped portion 314 provided at a lower part of the body portion 312.

The body portion 312 and the box-shaped portion 314 are integrally coupled to each other. A lower end part of the box-shaped portion 314 is bent at a right angle to form an input portion 315 extending in the X-axis direction. A downward pressing operation is input from the input portion 315. The box-shaped portion 314 is coupled to the frame 90 via a tension spring 316, whereby an upward pulling force is provided by the tension spring 316.

On the other hand, the arm portion 313 is formed with a slit 317 along the Y-axis direction. The engaging shaft 324 extending from the slide guide 320 is inserted into the slit 317. Accordingly, a downward movement input to the operation lever 310 is transmitted from the arm portion 313 to the slide guide 320 and the threading shaft 11 through the engaging shaft 324. An upward tension generated by the tension spring 316 reaches the slide guide 320 and the threading shaft 11 from the box-shaped portion 314 through the body portion 312. The slit 317 of the arm portion 313 is formed along the Y-axis direction in order to permit the movement in the Y-axis direction in accordance with the second support mechanism 200.

Threading Cam Mechanism

Figure 12:
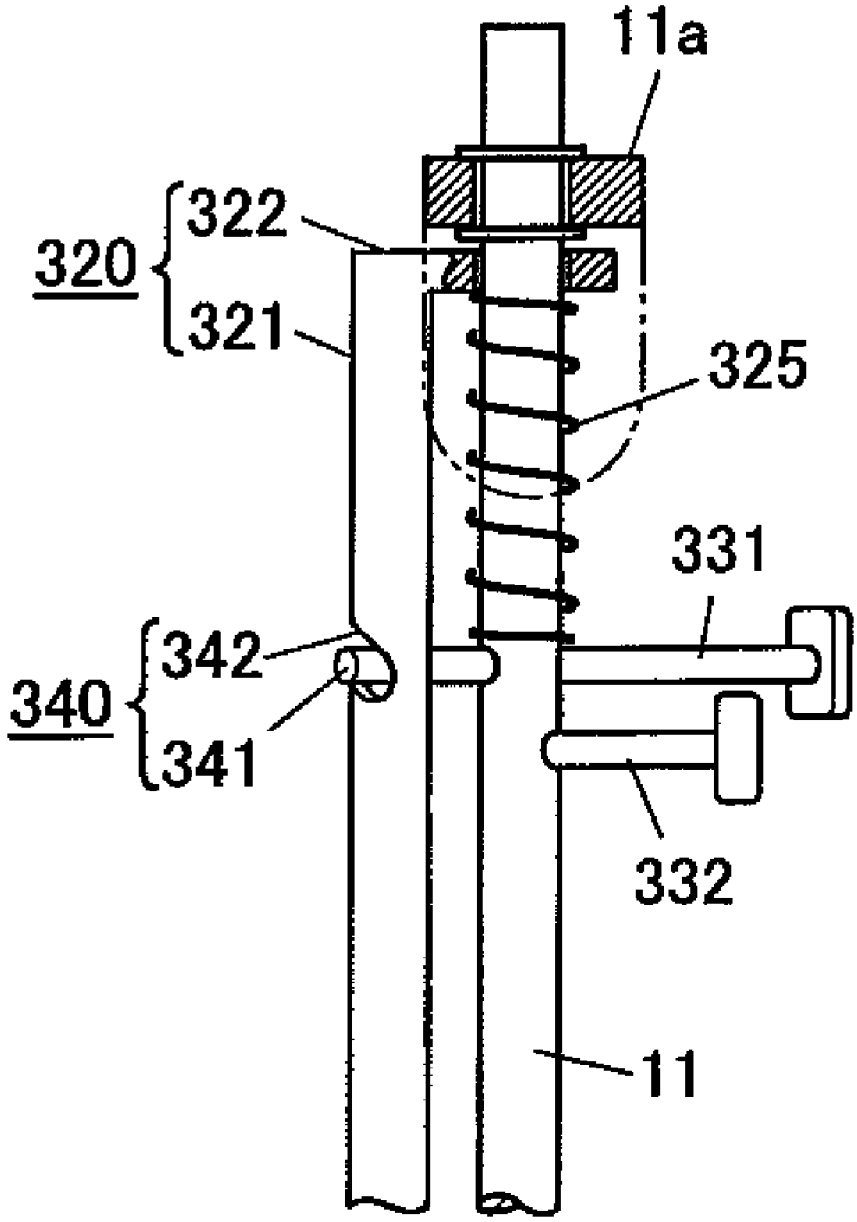
FIG. 12 is an explanatory view of a threading cam mechanism.
Figure 13:
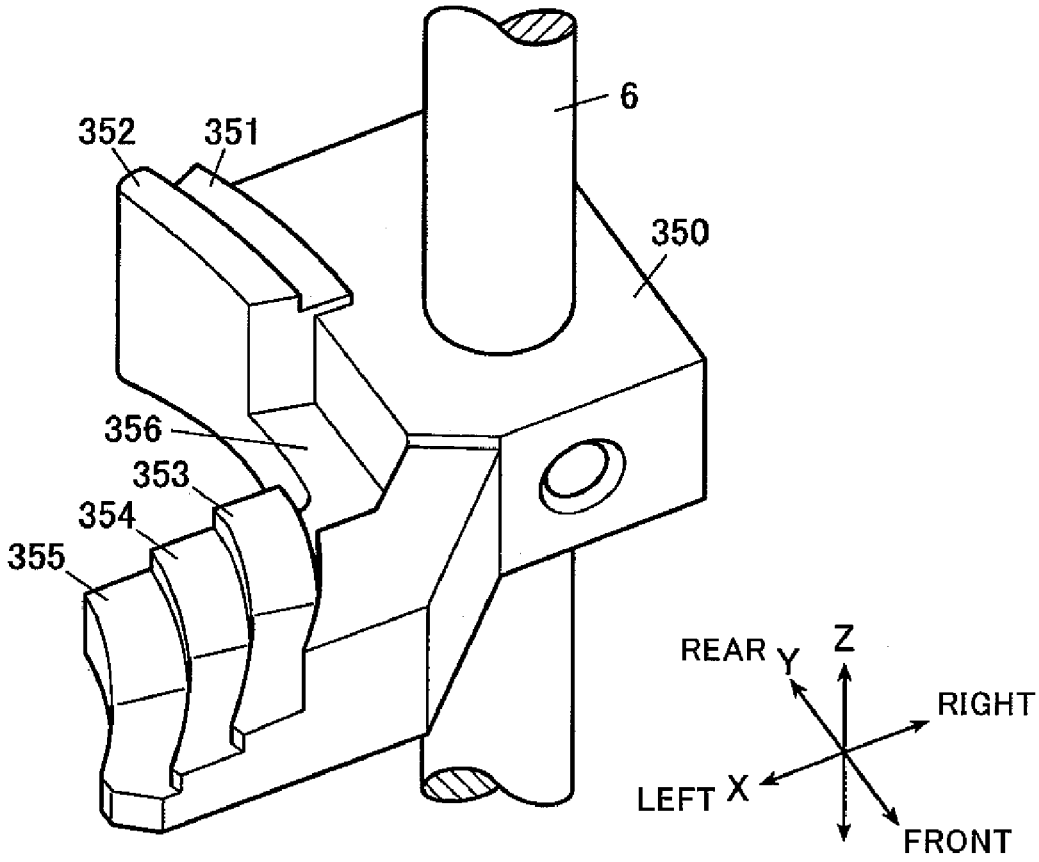
FIG. 13 is a perspective view of a lower threading guide.

As shown in FIG. 12, the threading cam mechanism 340 includes an engaging projection 341 protruded in a horizontal direction from the threading shaft 11 toward the back plate 321 of the slide guide 320, and a slot portion 342 formed in the back plate 321 of the slide guide 320.

The engaging projection 341 is a rear end part of the first guide pin 331 which penetrates through the threading shaft 11. The engaging projection 341 has such a length that is it inserted into the slot portion 342 to protrude out from the back plate 321.

The slot portion 342 is inclined with respect to the up-and-down direction. Due to an action of the compression coil spring 325, the engaging projection 341 is normally positioned at a lower end of the slot portion 342. The slot portion 342 is inclined such that, when the engaging projection 341 is moved upward along the slot portion 342, the threading shaft 11 is rotated in the direction in which the threading hook 20 moves forward. More specifically, when the threading shaft 11 is rotated in a clockwise direction in a top view, the threading hook 20 is moved forward. Thus, the slot portion 342 is inclined upward toward the rear in the Y-axis direction.

It is when the slide guide 320 relatively moves downward with respect to the threading shaft 11 that the engaging projection 341 is moved upward along the slot portion 342. The threading shaft 11 and the slide guide 320 moves up and down together unless a force greater than the biasing force of the compression coil spring 325 is applied. Accordingly, the height regulating mechanism 330 is provided in a middle of a downward moving path of the threading shaft 11 to block the downward movement so that, when the downward movement is input to the slide guide 320 and the threading shaft 11 from the operation lever 310, the downward movement of only the threading shaft 11 is blocked in the middle. At this time, when a pressing force greater than the compression coil spring 325 is input from the operation lever 310, the slide guide 320 is relatively moved downward with respect to the threading shaft 11 and the threading shaft 11 is rotated by an action of the threading cam mechanism 340 so that the threading hook 20 is moved forward to carry out the threading operation. When the operation lever 310 is released, the threading hook 20 is moved backward by a returning force of the compression coil spring 325.

Height Regulating Mechanism

The height regulating mechanism 330 has a function of blocking the downward movement of only the threading shaft 11 at a certain height during the downward movement of the slide guide 320 in order to actuate the threading cam mechanism 340, and a function of regulating the height of the threading hook 20 for each of the needles 1 to 5 in cooperation with the positioning mechanism 400 which moves and positions, when carrying out the threading operation to each of the needles 1 to 5, the threading shaft 11 so as to correspond to the arrangement of the needles.

More specifically, the height regulating mechanism 330 includes first and second guide pins 331, 332 which are provided on the threading shaft 11, a lower threading guide 350 having five contact portions 351 to 355 on which one of the guide pins 331, 332 contacts from above, and an upper threading guide 360 which guides a turning movement of each of the guide pins 331, 332 during the rotation of the threading shaft 11.

Each of the first and second guide pins 331, 332 is orthogonal to the threading shaft 11. The first guide pin 331 is disposed above the second guide pin 332. When seen in the X-Y plane with the threading shaft 11 being the center, the first and second guide pins 331, 332 are disposed on the threading shaft 11 at different angles.

The lower threading guide 350 is a block-shaped member which is fixedly supported on the needle bar 6, and has the contact portions 351 to 355 in an upper part thereof.

Figure 14A:
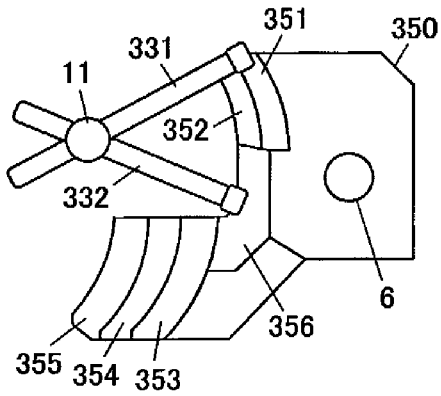
FIGS. 14A to 14E are explanatory views showing a relationship between each guide pin and a respective contact portion when the threading shaft is positioned, through a positioning mechanism, at a location corresponding to a respective needle.
Figure 14D:
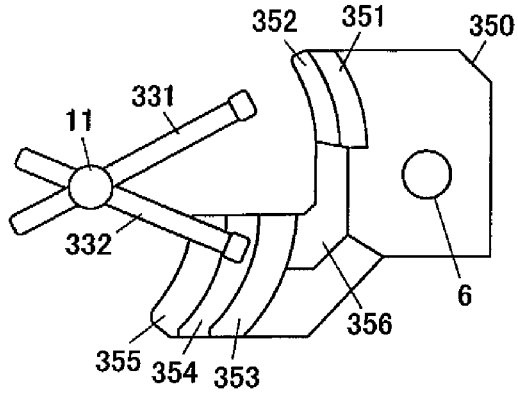
Figure 14B:
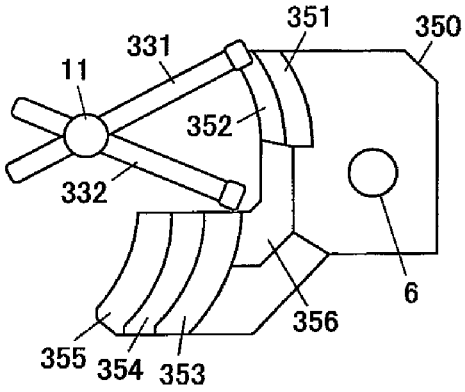
Figure 14E:
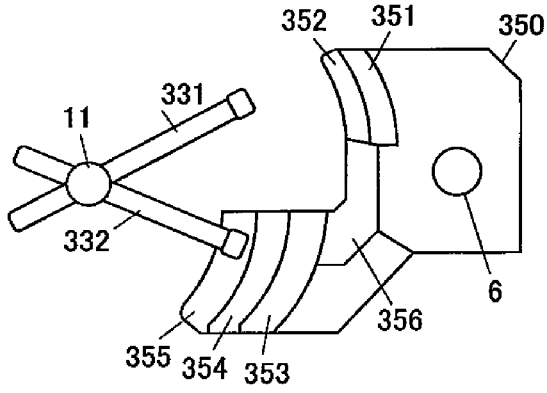
Figure 14C:
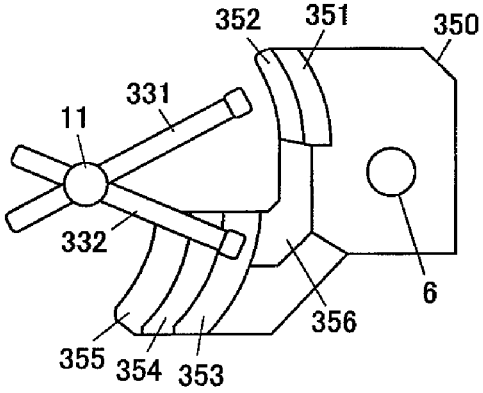
Figure 14C:
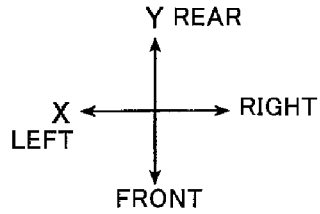

As shown in FIG. 14A, when the threading shaft 11 is placed in a position for threading the needle 1, the first guide pin 331 is moved downward to contact the contact portion 351. As shown in FIG. 14B, when the threading shaft 11 is placed in a position for threading the needle 2, the first guide pin 331 is moved downward to contact the contact portion 352. As shown in FIG. 14C, when the threading shaft 11 is placed in a position for threading the needle 3, the second guide pin 332 is moved downward to contact the contact portion 353. As shown in FIG. 14D, when the threading shaft 11 is placed in a position for threading the needle 4, the second guide pin 332 is moved downward to contact the contact portion 354. As shown in FIG. 14E, when the threading shaft 11 is placed in a position for threading the needle 5, the second guide pin 332 is moved downward to contact the contact portion 355.

Respective surfaces of the contact portions 351 to 355 are formed to in an arcuate shape such that the guide pins 331, 332 can maintain its contacting state when the threading shaft 11 is rotated. Further, each of the contact portions 351 to 355 determines the heights of the threading shaft 11 and the threading hook 20 at the time of threading work. Therefore, the heights of the respective surfaces are set to be different from each other, depending on the heights of the eyes of the respective needles 1 to 5.

The set of contact portions 351, 352 and the set of contact portions 353, 354, 355 are disposed apart from each other so as to correspond to an opening angle between the guide pins 331, 332 around the threading shaft 11. In this manner, the contact portions are distributed in accordance with the number of the guide pins to avoid an interference of the arrangement of the respective contact portions.

The first guide pin 331 and the second guide pin 332 have a difference in a height so that, when one of the guide pins 331, 332 contacts the corresponding one of the contact portions, the other does not contact any of the contact portions. Moreover, the lower threading guide 350 has a recess portion 356, which is formed by partially lowering an upper surface of the lower threading guide 350, so that, when one of the guide pins 331, 332 contacts the contact portion, the other does not contact a portion of the lower threading guide 350 other than the contact portion (see FIG. 14A).

Because the lower threading guide 350 has a function of determining the height of the threading hook 20 during the threading operation, it is required that it is always at the same height during the threading operation. Therefore, in the threading operation, the sewing machine motor is controlled such that the needle bar 6 is always at the same height, i.e., such that an upper shaft is always at the same angle.

When one of the guide pins 331, 332 contacts one of the contact portions 351 to 355 of the lower threading guide 350 and moves along the upper surfaces of the corresponding contact portion 351 to 355 in accordance with the rotation of the threading shaft 11, the upper threading guide 360 contacts the guide pin from above and guides the guide pin so as to maintain the contacting state.

Figure 15:
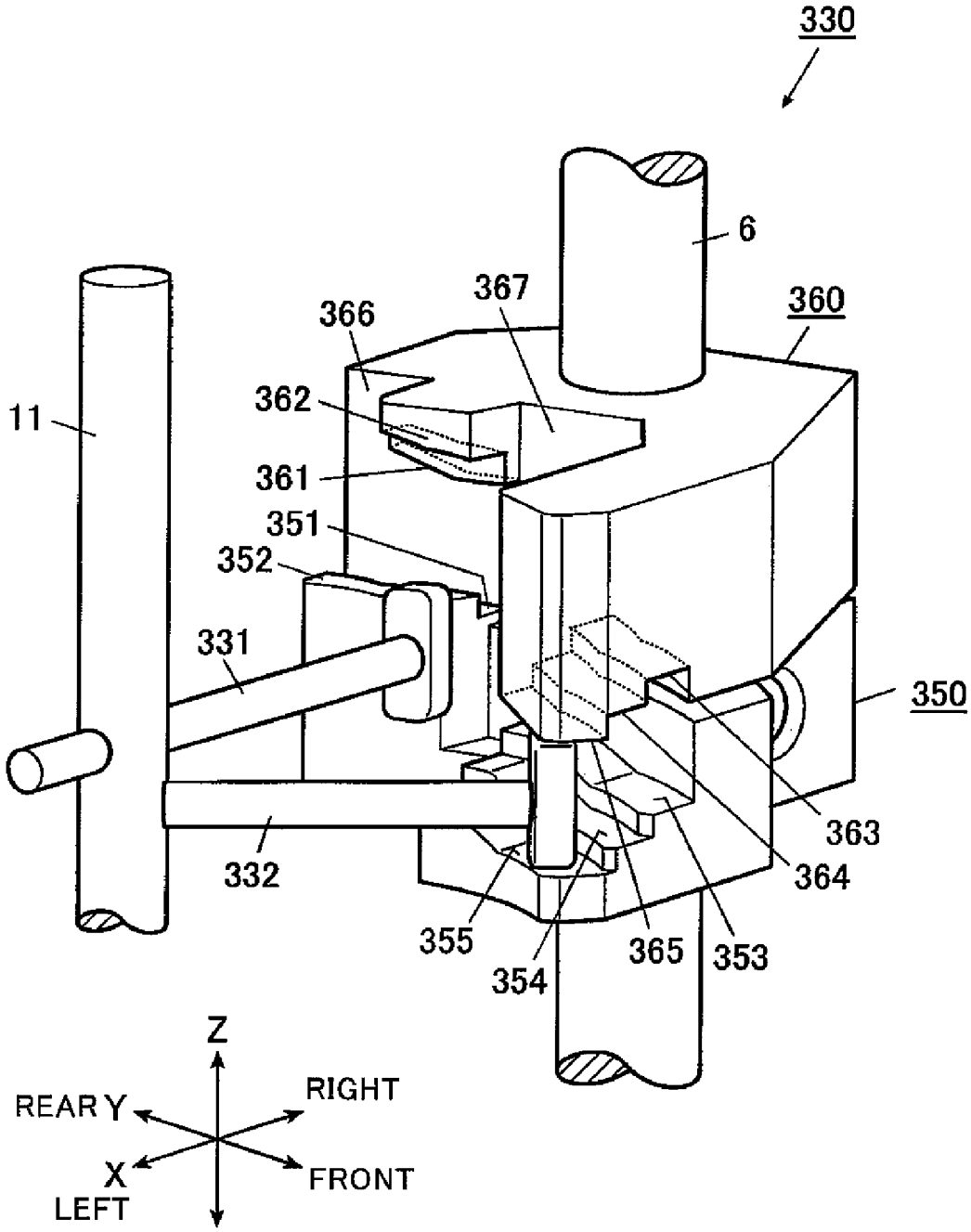
FIG. 15 is an enlarged perspective view of the lower threading guide and an upper threading guide.

As shown in FIG. 15, the upper threading guide 360 includes a guide portion 361 which contacts the first guide pin 331 from above to guide the first guide pin 331 when the first guide pin 331 is moved in contact with the contact portion 351 of the threading guide 350, another guide portion 362 which contacts the first guide pin 331 from above to guide the first guide pin 331 when the first guide pin 331 is moved in contact with the contact portion 352, another guide portion 363 which contacts the second guide pin 332 from above to guide the second guide pin 332 when the second guide pin 332 is moved in contact the contact portion 353, another guide portion 364 which contacts the second guide pin 332 from above to guide the second guide pin 332 when the second guide pin 332 is moved in contact with the contact portion 354, another guide portion 365 which contacts the second guide pin 332 from above to guide the second guide pin 332 when the second guide pin 332 is moved in contact with the contact portion 355, a recess portion 366 which allows a downward movement of the first guide pin 331 when the threading shaft 11 is moved downward, and another recess portion 367 which allows the downward movement of the second guide pin 332 when the threading shaft 11 is moved downward.

Thread Holding Mechanism

Figure 16A:
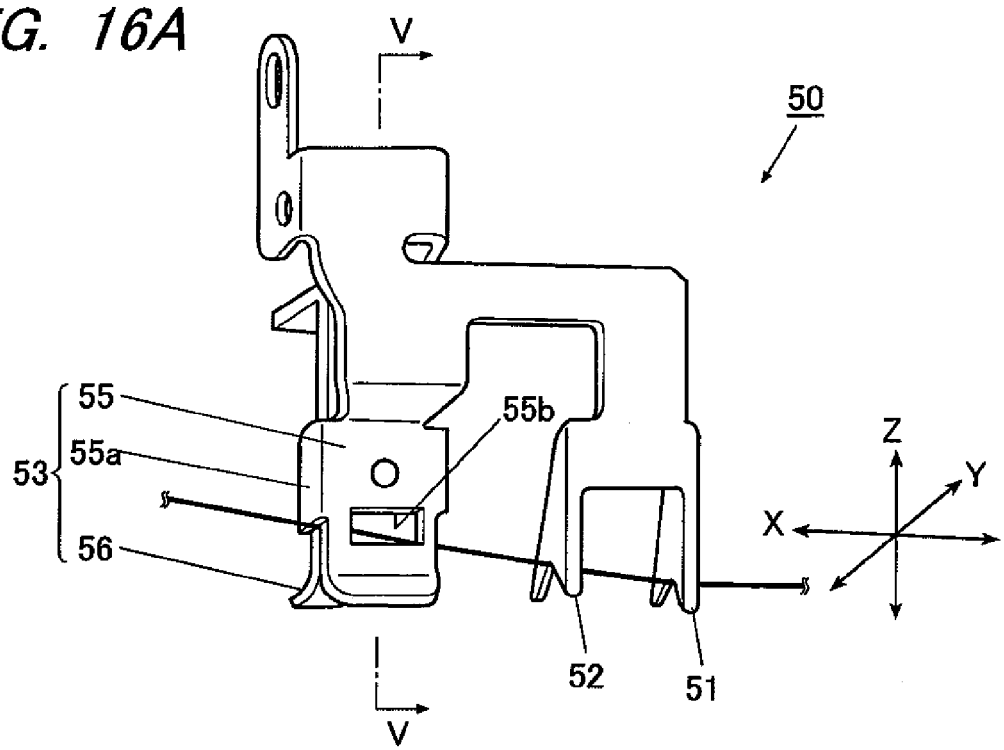
FIG. 16A is a perspective view of a thread holding mechanism.
Figure 16B:
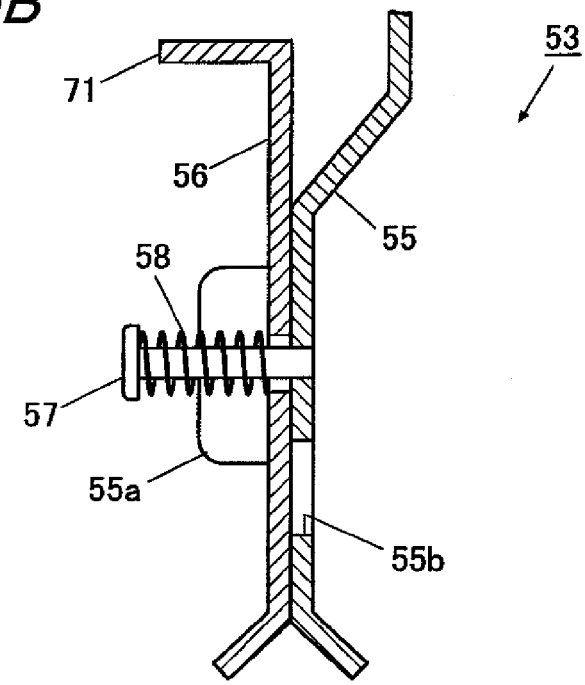
FIG. 16B is a sectional view taken along the line V-V in FIG. 16A.

The thread holding mechanism 50 is formed by sheet metal bending processing. As shown in FIG. 16, the thread holding mechanism 50 includes two thread rest portions 51, 52 having lower end parts between which a thread is rested, and a pinching section 53 having a plate spring to pinch an end portion of the thread. Each of the two thread rest portions 51, 52 has a cutout portion for resting the thread so that the thread can be passed in the X-axis direction between the cutout portions.

The pinching section 53 includes a body plate 55 (an pinching member) which formed integrally with the thread rest portions 51, 52, a rotating plate 56 (another pinching member) which is rotatable with respect to the body plate 55, a support pin 57 which rotatably supports the rotating plate 56, and a pressing spring 58 (a first elastic member) which biases the rotating plate 56 toward the body plate 55. Each of the body plate 55 and the rotating plate 56 extends such that a distal end part thereof is directed downward, and the rotating plate 56 pinches the thread by rotating its lower end part.

The support pin 57 is extended in the Y-axis direction from a rear side of the body plate 55. The rotating plate 56 has a through hole, and the support pin 57 is inserted into the through hole with a play. An inner diameter of the through hole of the rotating plate 56 is greater than an outer diameter of the support pin. That is, because a clearance is provided between the rotating plate 56 and the support pin 57, the rotating plate 56 is rotatable with respect to the body plate 55.

The body plate 55 has side wall portions 55*a* which are formed by bending right and left side portions along the Y-Z plane. Each of the side wall portions 55*a* are positioned above a lower end part of the body plate 55, and are bent toward the rotating plate 56. Accordingly, a rotation of the rotating plate 56 around the support pin 57 is prevented. Further, each of the side wall portions 55*a* is configured such alit a lower end thereof is lower than the support pin 57. Therefore, the lower ends of the side wall portions 55*a* serves as a stopper that prevents the thread from entering toward the support pin 57 when interposing the thread from above.

The pinching section 53 is configured such that the lower end part of the rotating plate 56 is openable and closable with respect to the lower end part of the body plate 55, and it is desirable that the thread be smoothly released due to its own weight when the rotating plate 56 is opened. According to this embodiment, the thread is favorably released because each of the side wall portions 55*a* prevents the thread from excessively entering between the rotating plate 56 and the body plate 55.

The body plate 55 is formed with a window 55*b*. The window 55*b* is provided in a location at which the thread caught by the side wall plate 55*a* is visually recognizable. As long as it is located such that the pinched thread is visually recognizable, the window 55*b* may be provided in the rotating plate 56 or may be provided in each of the body plate 55 and the rotating plate 56. Nevertheless, like in this embodiment, it is desirable that the window 55*b* be provided in a location that allows the pinched thread to be observed from a position of an operator working on the sewing machine.

As described above, the pinching section 53 is disposed next to the two thread rest portions 51, 52 in the same arranging direction. By passing the thread between the two thread rest portions 51, 52 and pinching the residual end portion of the thread with the pinching section 53, it is possible to maintain a state in which the thread is extended in the X-axis direction between the two thread rest portions 51, 52.

In the state in which the thread is extended in the X-axis direction, the thread holding mechanism 50 is disposed on an opposite side to the threading hook 20 with respect to the thread, whereby the threading hook 20 is moved forward in the Y-axis direction to pass directly above the thread, and smoothly catches the thread with the barb of the threading hook 20 during its backward movement.

Support Mechanism for Thread Holding Mechanism

Figure 17:
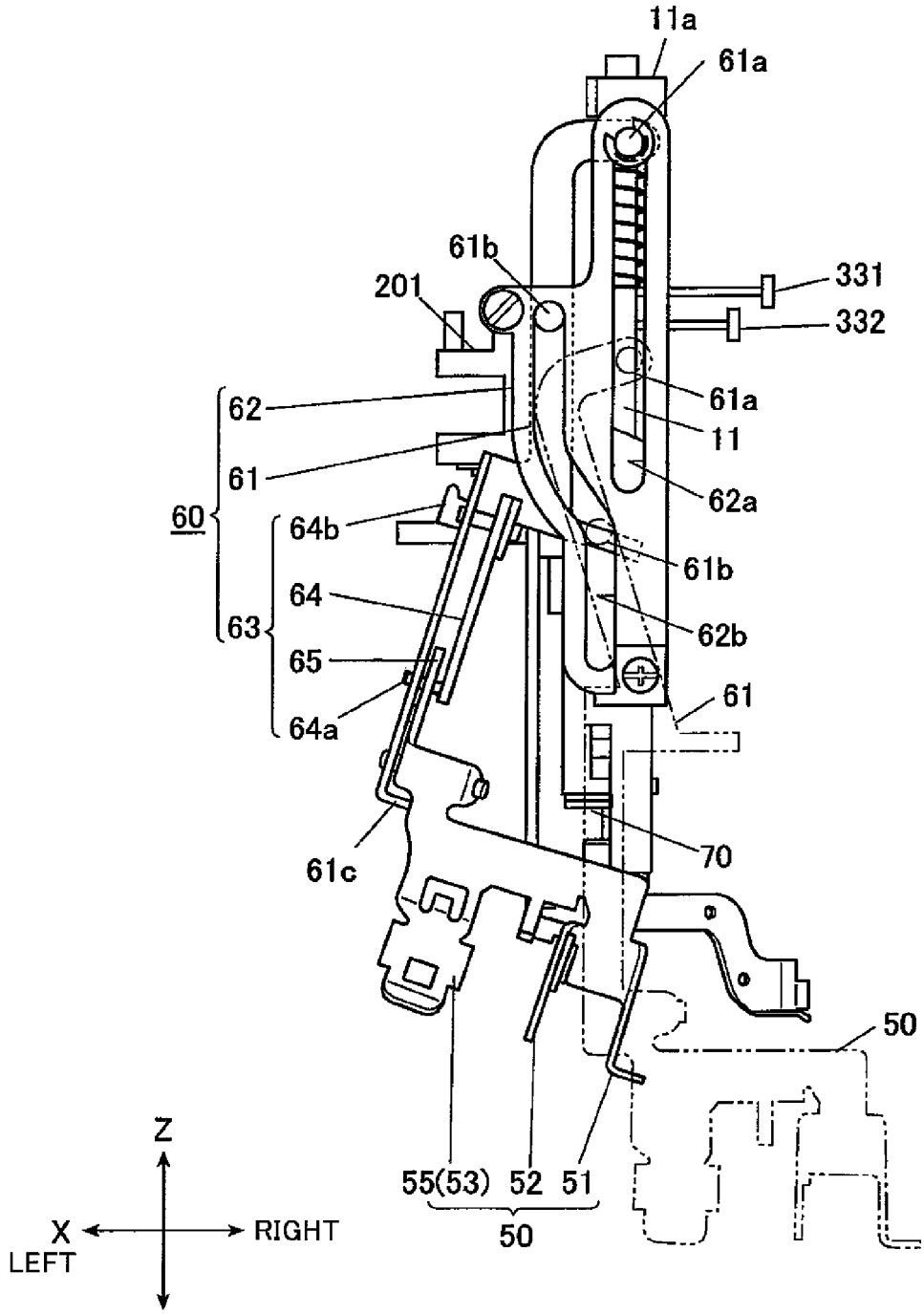
FIG. 17 is a front view of the thread holding mechanism and a support mechanism thereof.
Figure 18:
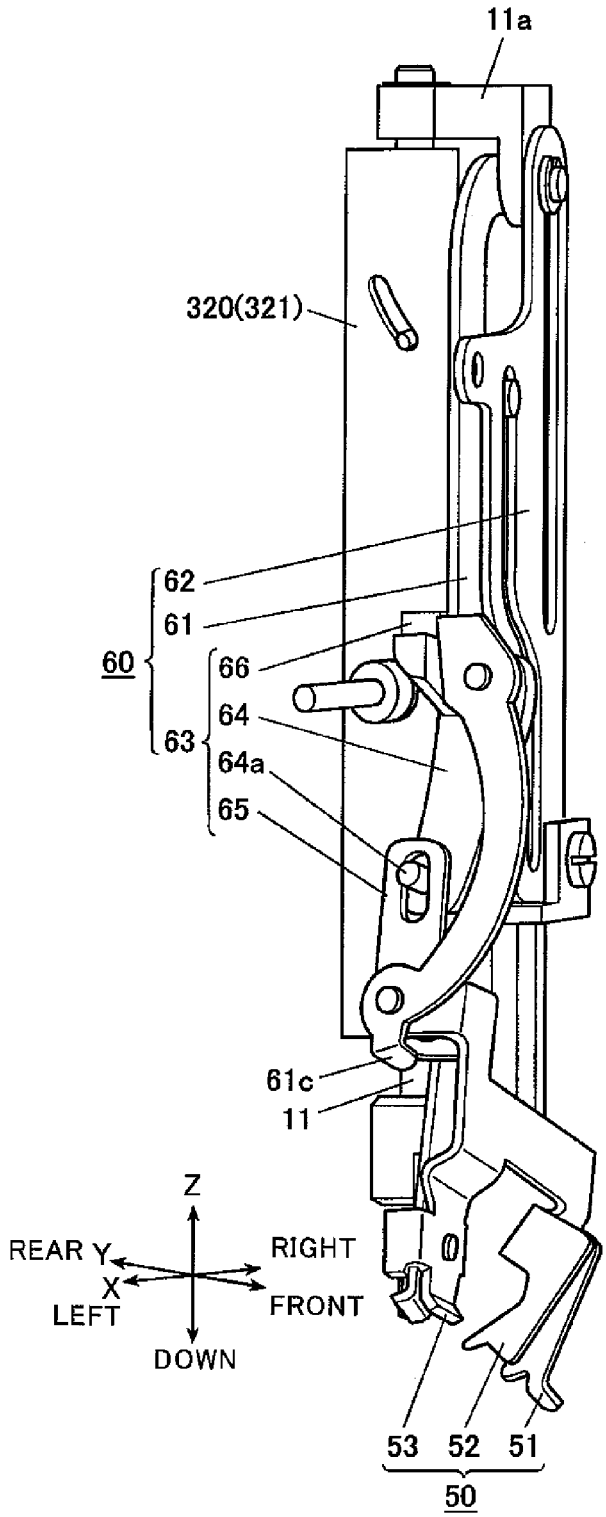
FIG. 18 is a perspective view of the thread holding mechanism and the support mechanism thereof, showing a state before a threading operation.

The support mechanism 60 for the thread holding mechanism 50 will be described with reference to FIGS. 17 to 20. In FIG. 17, the thread holding mechanism 50 placed in a threading position is shown in a two-dotted chain line. As shown in the solid line in FIG. 17, the thread holding mechanism 50 placed in a standby position is inclined more or less in a clockwise direction around the Y axis as compared with the case in which the threading holding mechanism 50 is placed in the threading position.

The support mechanism 60 includes a moving member 61 which supports the thread holding mechanism 50 so as to be rotatable substantially about the X axis in front of the first frame member 101, a cam plate 62 which is fixedly supported on the front side of the first frame member 101 and which supports the moving member 61 so as to be movable in the up-and-down direction and rotatable about the Y axis, and a rotation applying mechanism 63 which provides a rotation to the thread holding mechanism 50 at a lower end part of the moving member 61.

The cam plate 62 is held along the X-Z plane by the first frame member 101, and is formed with first and second cam grooves 62*a*, 62*b* along the up-and-down direction. The first cam groove 62*a* is linearly formed along the Z-axis direction. The second cam groove 62*b* is adjacent to the left of the first cam groove 62*a*, and has upper and lower end sections that are formed along the Z-axis direction, and is partially bent at an intermediate section thereof such that the lower end section is shifted to the right.

An upper end part of the moving member 61 is coupled to the stopper 11*a* provided on the upper end part of the threading shaft 11, and includes a first follower projection 61*a* which slides along the first cam groove 62*a*. The moving member 61 further includes, at a position lower than the first follower projection 61*a*, a second follower projection 61*b* which slides along the second cam groove 62*b*. The moving member 61 is coupled to the threading shaft 11 via the stopper

11*a*. Thus, when the operation lever 310 is pressed down to execute the threading operation, the moving member 61 is moved downward together with the threading shaft 11, and is stopped together in a lower stopping position of the threading shaft 11.

As described above, the second cam groove 62*b* is bent rightward in the middle. Accordingly, a lower part of the moving member 61 is moved rightward during its downward movement. As a result, the moving member 61 is rotated in a counterclockwise direction around the Y axis, so that the thread that is passed between the two thread rest portions 51, 52 faces against the threading hook 20 which is moving forward.

The moving member 61 is formed by sheet metal bending processing. The moving member 61 has an upper half part arranged along the X-Z plane, and is bent in the middle such that a lower half part is arranged substantially along the Y-Z plane. A lower end part of the lower half part of the moving member 61 supports the thread holding mechanism 50 via a support shaft which is orthogonal to the plate surface such that the thread holding mechanism 50 is rotatable about the X axis. A lowermost end part of the moving member 61 has a stopper 61*c* which is protruded substantially along the X-Y plane. The stopper 61*c* contacts the thread holding mechanism 50 when the thread holding mechanism 50 is rotated, and thus determines a position of the thread holding mechanism 50.

The rotation applying mechanism 63 includes a swinging link member 64 which is supported on an upper end part of the lower half of the moving member 61 so as to be rotatable about the X axis, a driven arm portion 65 which is formed integrally with the body plate 55 of the thread holding mechanism 50 and extends upward from an upper end part of the body plate 55, and an engaging projection 66 which is provided on the back plate 321 of the slide guide 320 and which provides a swinging movement to the swinging link member 64.

Figure 19:
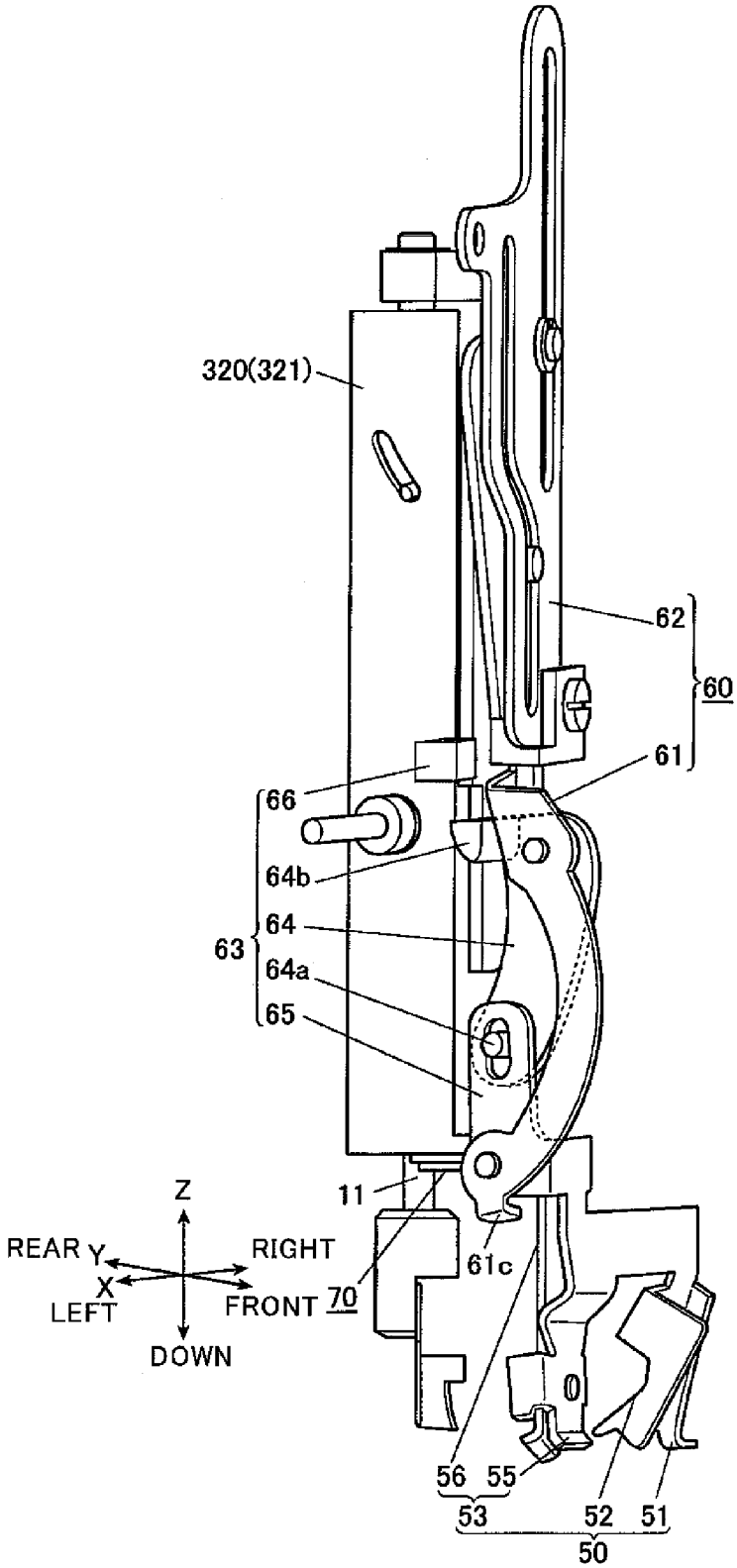
FIG. 19 is a perspective view showing the thread holding mechanism and the support mechanism thereof, showing a state after a rotation of a moving member which is caused by a downward movement of a slide guide in the threading operation.

The swinging link member 64 is extended in the up-and-down direction, and an upper end part thereof is supported on the moving member 61. A pin 64*a* along the X-axis direction is fixed to a lower end part of the swinging link member 64. The driven arm portion 65 is formed with a slot in the Z-axis direction into which the pin 64*a* is inserted. In FIG. 19, when the swinging link member 64 is rotated in the counterclockwise direction, the body plate 55 is rotated in a clockwise direction via the driven arm portion 65. The body plate 55 is rotated in the clockwise direction to bring the thread provided between the thread rest portions 51, 52 toward the needle 1 to 5.

A contact projection 64*b* is provided at the upper end part of the swinging link member 64. The contact projection 64*b* contacts the engaging projection 66 disposed on the slide guide 320 from below. A relative arrangement of the engaging projection 66 and the contact projection 64*b* is set such that they are arranged next to each other in the up-and-down direction when the moving member 61 is rotated in the counterclockwise direction by means of the cam grooves 62*a*, 62*b* of the cam plate 62.

Figure 20:
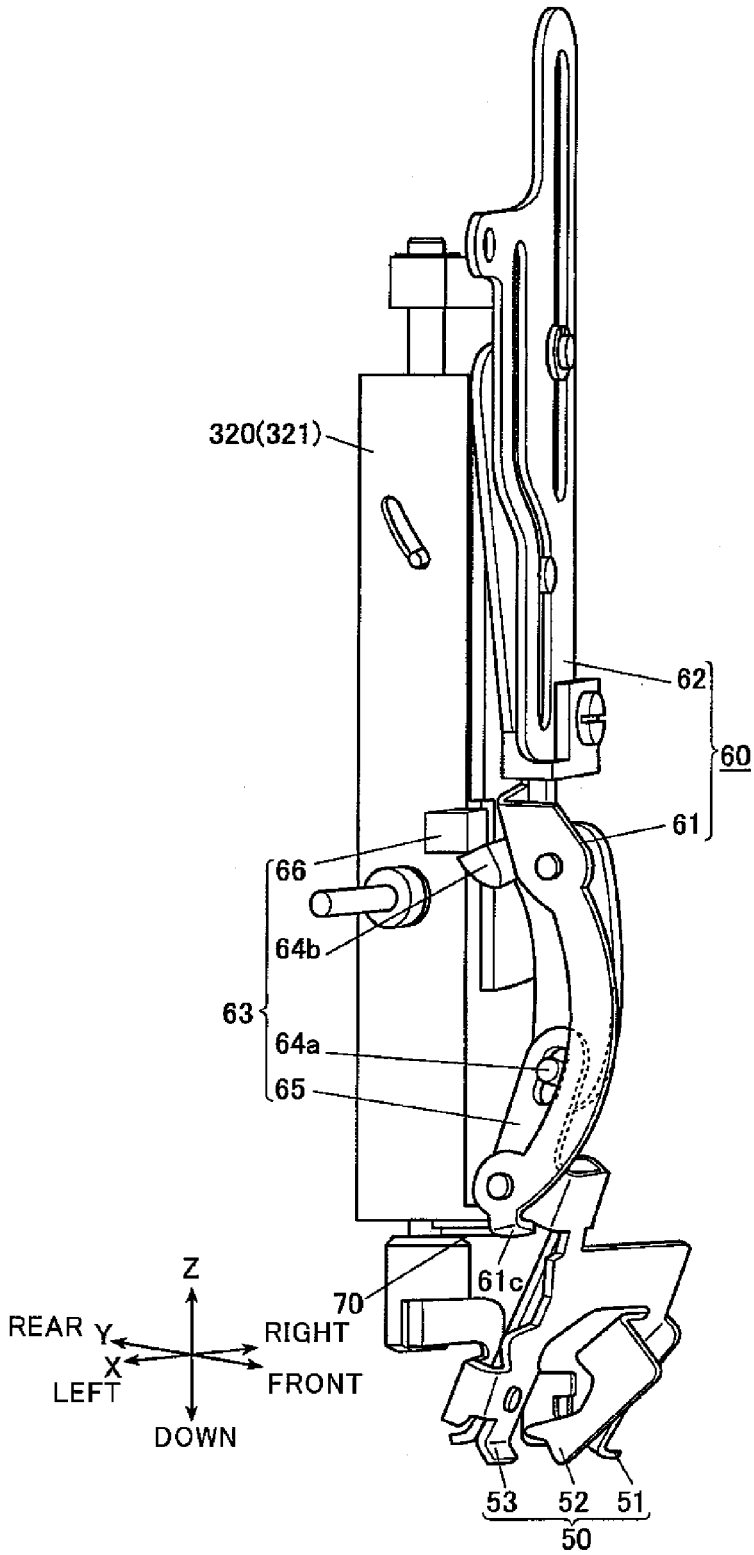
FIG. 20 is a perspective view of the thread holding mechanism and the support mechanism thereof, showing a state in which the slide guide has reached a lowermost point in the threading operation.
Figure 21:
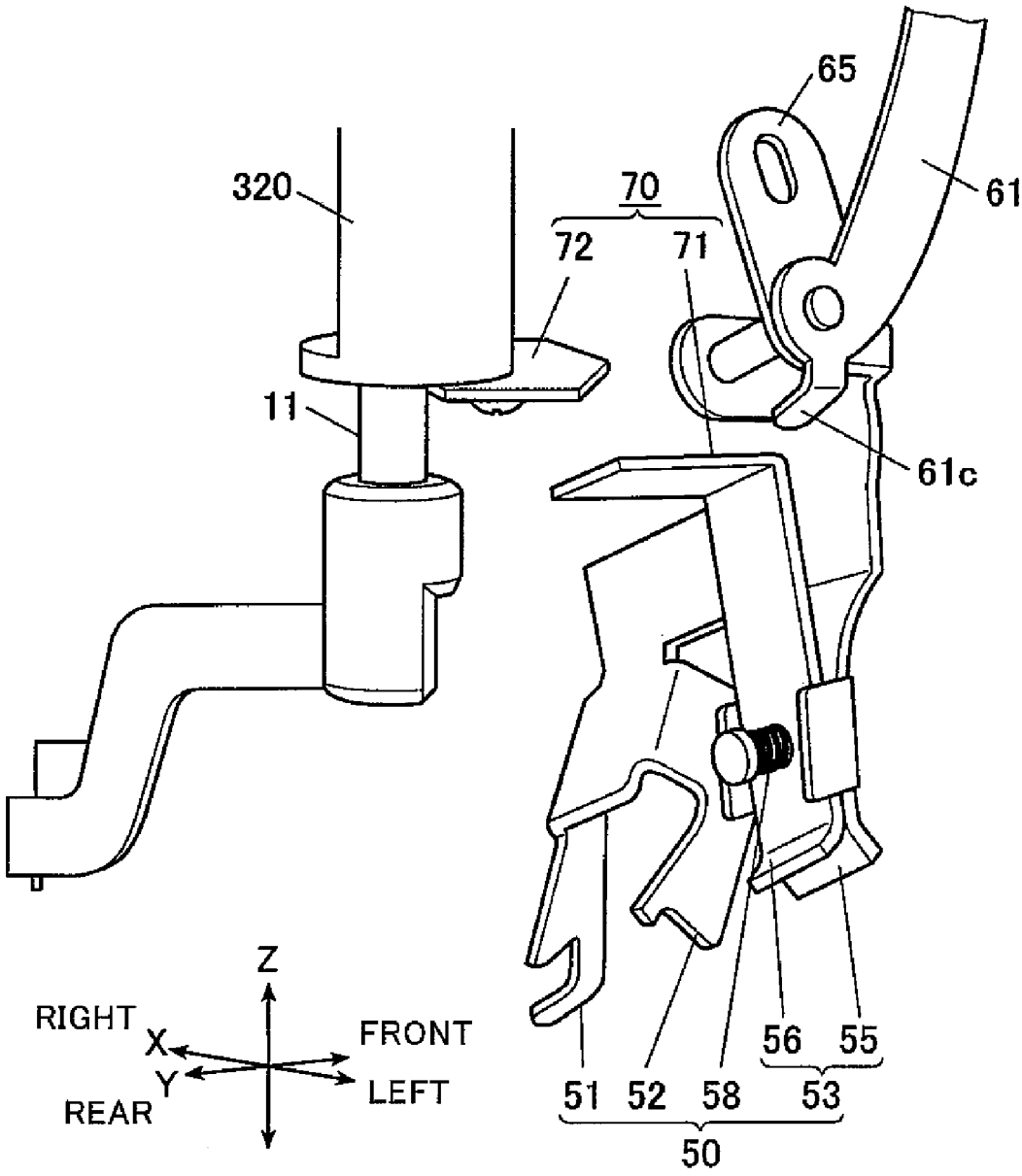
FIG. 21 is a perspective view of a portion including a thread releasing mechanism.
Figure 22:
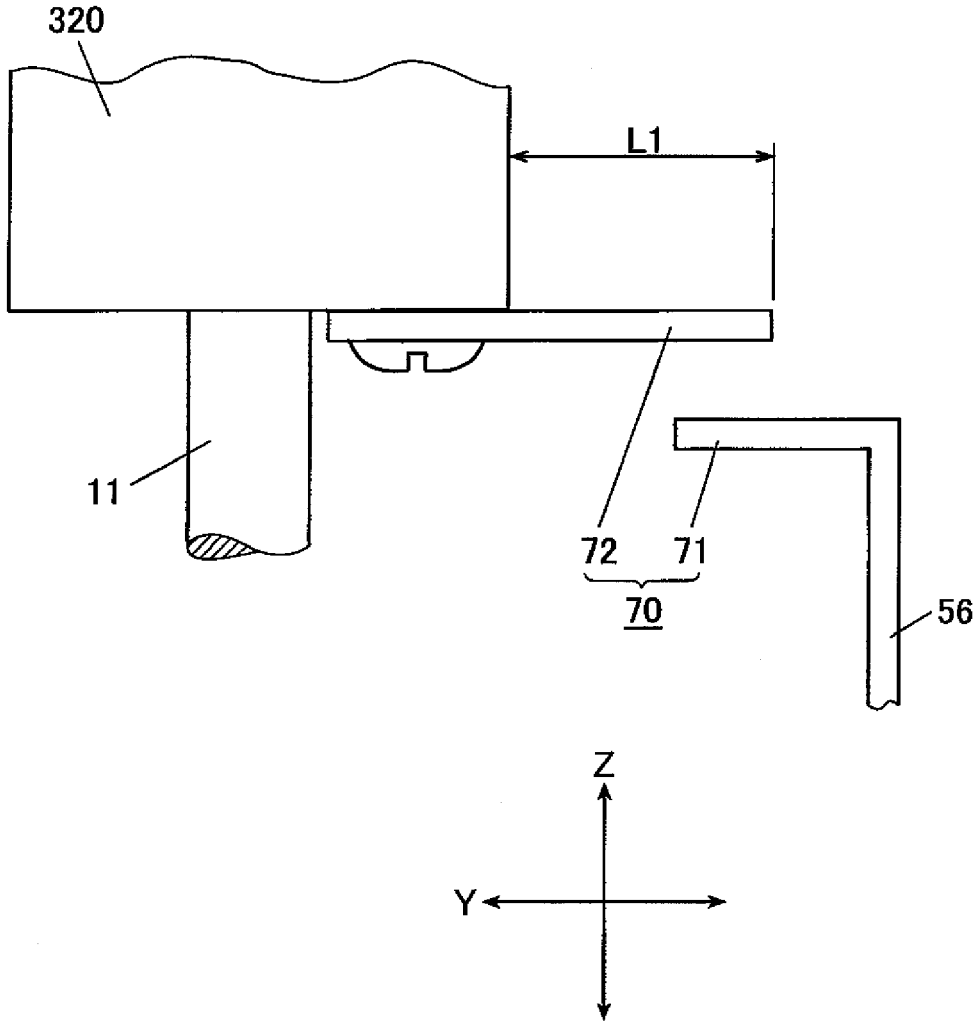
FIG. 22 is an explanatory view showing the thread releasing mechanism.

The slide guide 320 is moved downward together with the threading shaft 11 when the threading operation is input. Thereafter, when one of the guide pins 331, 332 contacts the lower threading guide 350 so that only the threading shaft 11 is prevented from moving downward, only the slide guide 320 is further moved downward. At this time, the engaging projection 66 is relatively moved downward with respect to the contact projection 64*b* of the swinging link member 64 supported on the moving member 61 which completely interlocks with the threading shaft 11. As shown in FIG. 20, the engaging projection 66 contacts and presses the contact projection 64*b* from above. At this time, because the contact projection 64*b* is provided in a position which is shifted toward a rear in the Y-axis direction with respect to the shaft of the swinging link member 64, the lower end part of the swinging link member 64 is rotated toward the front.

On the other hand, because the driven arm portion 65 is coupled to the pin 64*a* on the lower end part of the swinging link member 64 via the slot, it is rotated toward the front. As a result, the body plate 55, which is on an opposite side to the swinging arm 65 with respect to the shaft, is rotated toward the rear so that the thread provided between the thread rest portions 51, 52 is brought toward the needle 1 to 5.

Thread Releasing Mechanism

The thread releasing mechanism 70 includes a contact part 71 which is provided integrally with an upper end part of the rotating plate 56 of the thread holding mechanism 50, and a thread releasing plate 72 (a second elastic member) which contacts the contact part 71 to rotate the rotating plate 56.

The contact part 71 is bent orthogonally to a plate surface of the rotating plate 56 at the upper end part of the rotating plate 56, and is extended toward the rear in the Y-axis direction.

The thread releasing plate 72 is fixed, with a screw, to a lower end part of the slide guide 320 so as to extend from the slide guide 320 toward the front in the Y-axis direction. The thread releasing plate 72 has such a length that a distal end part of the thread releasing plate 72 contacts a distal end part of the contact part 71 when the slide guide 320 is moved in the up-and-down direction.

A relationship between relative heights of the thread releasing plate 72 and the contact part 71 is set such that the thread releasing plate 72 is positioned above the contact part 71 at the time when the threading shaft 11 is prevented from moving downward and only the slide guide 320 starts the downward movement in the downward movement of the threading operation and such that the thread releasing plate 72 is positioned below the contact part 71 when the slide guide 320 reaches the lowermost position.

Figure 23A:
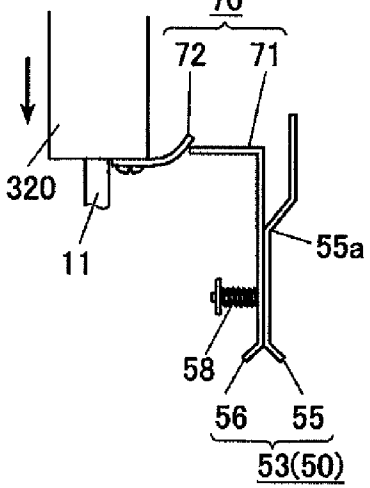
FIGS. 23A to 23D are explanatory views sequentially showing a movement of the thread releasing mechanism.

As shown in FIG. 23A, when the thread releasing plate 72 contacts the contact part 71 from above while only the slide guide 320 is moving downward, the thread releasing plate 72 is flexed over an extended length L1. Spring constants of the thread releasing plate 72 and the pressing spring 58, and dimensions of the body plate 55, the rotating plate 56 and the thread releasing plate 72 are set such that a moment applied to the rotating plate 56 from the thread releasing plate 72 around the bent portion 55*a* of the body plate 55 at this time is far smaller than a moment applied to the rotating plate 56 from the pressing spring 58. Therefore, even when the thread releasing plate 72 contacts the contact part 71, the rotating plate 56 maintains its orientation in contact with the body plate 55 and continuously pinches the thread.

Figure 23B:
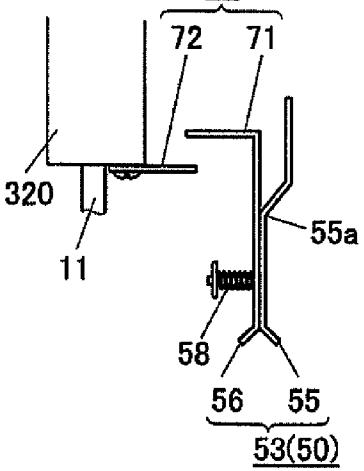

As shown in FIG. 23B, the thread releasing plate 72 reaches a position below the contact part 71 by being flexed upward. At this time, the threading shaft 11 is rotated by an action of the threading cam mechanism 340 so that the threading hook 20 is moved forward to penetrate through the eye of the needle to capture the thread held by the thread holding mechanism 50. Although the thread holding mechanism 50 is actually tilted more or less in the clockwise direction by an action of the thread holding mechanism support mechanism 60, the thread holding mechanism 50 is not illustrated in a tilted condition in FIG. 23B in order to simplify an explanation of the operation. It is to be noted that the thread releasing plate 72 has such a length that the distal end of the thread releasing plate 72 reaches the contact part 71 even in a state in which the thread holding mechanism 50 is tilted.

Figure 23C:
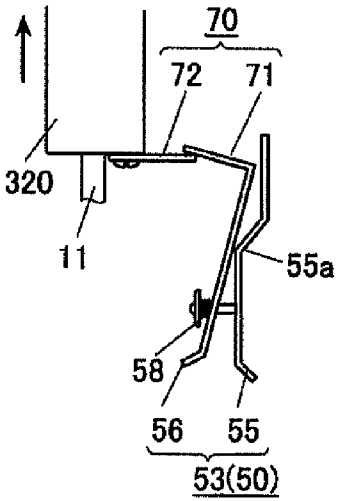
Figure 23D:
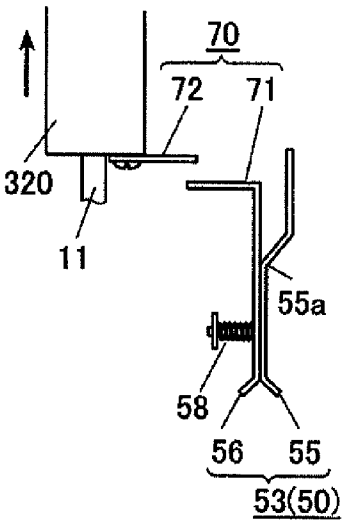
Figure 23D:
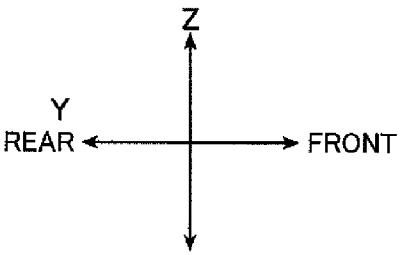
Figure 24:
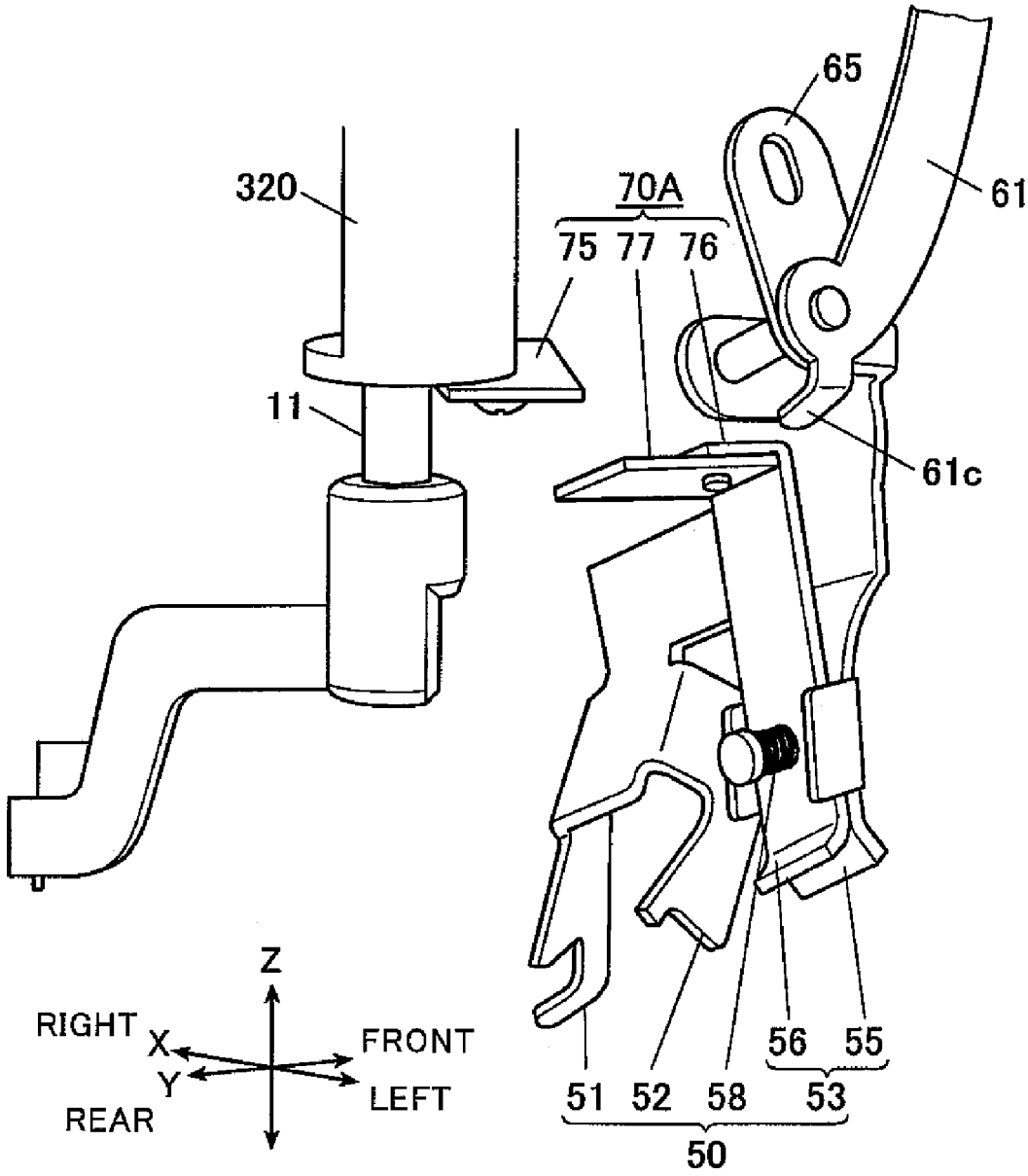
FIG. 24 is a perspective view of a thread releasing mechanism according to another embodiment of the present invention.
Figure 25:
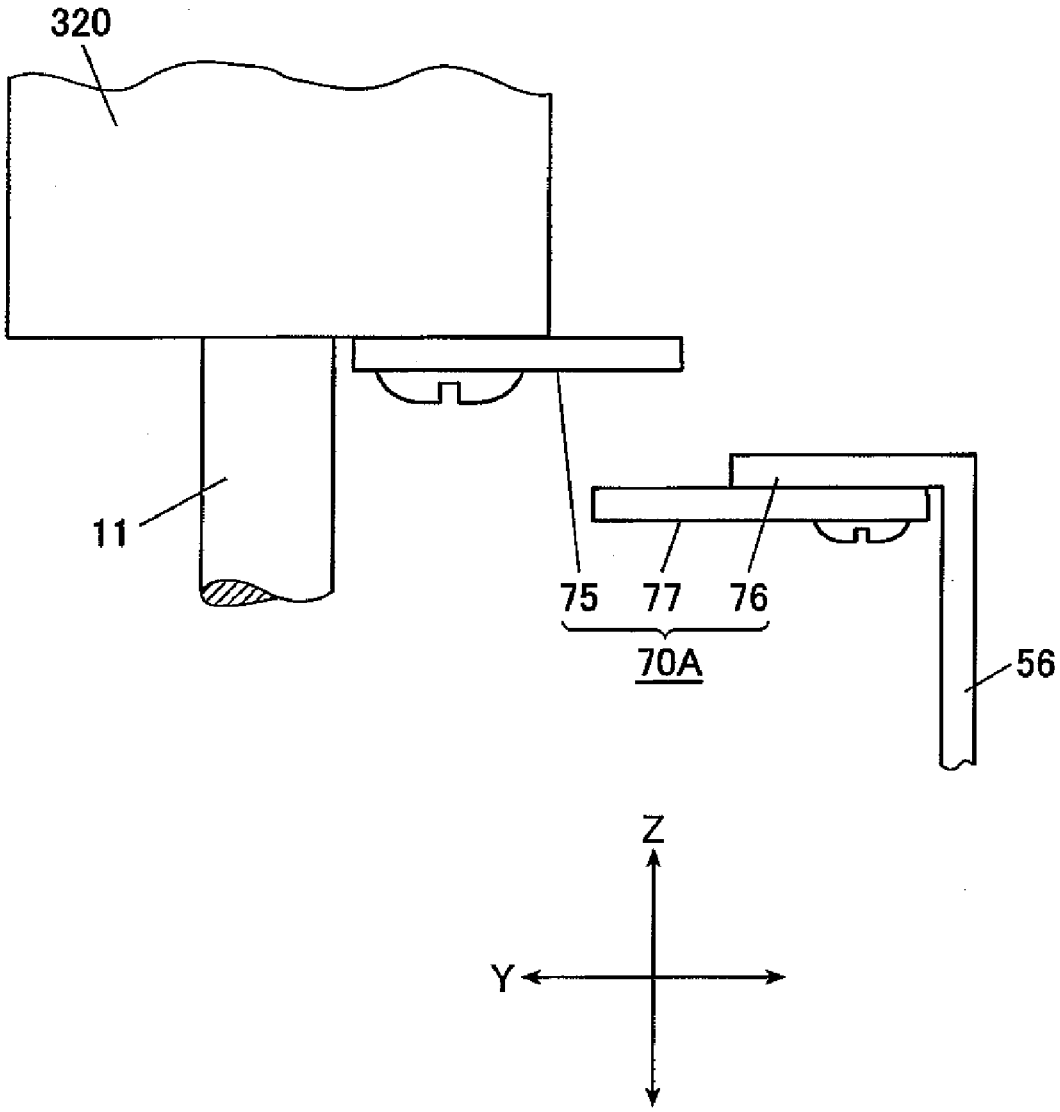
FIG. 25 is an explanatory view of the thread releasing mechanism shown in FIG. 24.

Subsequently, when the slide guide 320 starts an upward movement from the lower dead point, the threading shaft 11 is rotated in a reverse direction by the action of the threading cam mechanism 340, and the threading hook 20 is moved backward to move out of the eye of the needle so that the thread is pulled into the eye. The thread releasing plate 72 contacts the contact part 71 from below immediately after the slide guide 320 starts the upward movement. The spring constants of the thread releasing plate 72 and the pressing spring 58, and the dimensions of the body plate 55, the rotating plate 56 and the thread releasing plate 72 are set such that the moment applied to the rotating plate 56 from the thread releasing plate 72 around the bent portion 55*a* of the body plate 55 at this time is greater than the moment applied to the rotating plate 56 from the pressing spring 58. Therefore, as shown in FIG. 23C, when the thread releasing plate 72 biases the contact part 71 from below, the rotating plate 56 rotates in the clockwise direction around the bent portion 55*a* so as to move away from the body plate 55 so that the thread is released. Thereafter, as shown in FIG. 23D, the thread releasing plate 72 rotates and pushes away the contact part 71, and reaches a portion above the contact part 71.

Explanation of Operation of Threading Device

Description will be given to a threading operation of the threading device 10 having the configuration described above.

First of all, the needle 1 to 5 to be threaded is selected by the rotating operation of the dial 441. At this time, in accordance with an angular position of the dial 441, the first cam mechanism 420 moves the first frame member 101 of the first support mechanism 100 in the X-axis direction, and the second cam mechanism 430 moves the second frame member 201 of the second support mechanism 200 in the Y-axis direction. That is, the threading shaft 11 is positioned in the X-Y plane in accordance with the cooperation of the first cam mechanism 420 and the second cam mechanism 430.

At this point, it is determined which of the guide pins 331, 332 of the height regulating mechanism 330 contacts which of the contact portions 351 to 355.

When the operation lever 310 is operated downward, the threading shaft 11 starts the downward movement together with the slide guide 320. In addition, the stopper 11*a* on the upper end part of the threading shaft 11 presses the moving member 61 downward so that the thread holding mechanism 50 also starts the downward movement.

When one of the guide pins 331, 332 extending from the threading shaft 11 contacts one of the contact portions 351 to 355, the downward movement of the threading shaft 11 is blocked. That is, the heights of the threading shaft 11 and the threading hook 20 are adjusted to correspond to the height of the selected needle. Similarly, the height of the thread holding mechanism 50, which interlocks via the moving member 61, is also adjusted to correspond to the height of the selected needle.

When the operation lever 310 is further pushed downward, only the slide guide 320 is moved downward with respect to the threading shaft 11 so that the threading shaft 11 is rotated in the clockwise direction by the action of the threading cam mechanism 340. In addition, the rotation applying mechanism 63 rotates the thread holding mechanism 50 toward a position at which the thread holding mechanism 50 contact the stopper 61*c*. As a result, the threading hook 20 is moved forward to penetrate through the eye of the selected needle, the thread holding mechanism 50 is turned toward the needle to cause the thread extended in the X-axis direction to approach to the front of the threading hook 20, and the barb of the threading hook 20 captures the thread. At this time, the thread releasing plate 72 positioned on the lower end part of the slide guide 320 contacts the contact part 71 from above and is flexed upward to moved to the lower side of the contact part 71.

When the operation lever 310 is released from the downward pressing state, firstly, only the slide guide 320 first starts relatively move upward with respect to the threading shaft 11, and the threading hook 20 starts the backward movement to pull the captured thread into the eye of the needle, whereby the threading operation is executed. Immediately after the backward movement of the threading hook 20 is started, the thread releasing plate 72 contacts the contact part 71 from below to rotate the contact part 71 and the rotating plate 56 so that the pinching section 53 is opened to release the thread. Accordingly, the thread is smoothly pulled into the eye of the needle.

Further, in a case in which another needle is to be threaded, the dial 441 is rotated again and the operation lever 310 moved downward.

According to the threading device 10 described above, the threading shaft 11 is supported by the first support mechanism 100 and the second support mechanism 200 so as to be movable in the X-Y plane. Further, in accordance with the rotating operation of the dial 441, and in accordance with the cooperation of the two cam mechanisms 420, 430 of the positioning mechanism 400, the threading shaft 11 is selectively moved and positioned in five positions corresponding to the respective needles 1 to 5.

Therefore, even in a sewing machine which includes five needles 1 to 5 which are not simply arranged in a line, e.g., a sewing machine capable of implementing overlock stitching and cover stitching, it is possible to position the threading shaft 11 only by the rotating operation of the dial 441, without requiring to input an individual position adjusting operation in a plurality of directions. In addition, it is also possible to carry out an alignment in the order corresponding to the needles 1 to 5. Accordingly, it is possible to carry out an accurate threading operation for all of the needles 1 to 5.

Moreover, the thread holding mechanism 50 is supported by the first frame member 101 via the moving member 61. Accordingly, not only the threading shaft 11, but also the thread holding mechanism 50 can be sequentially positioned in the X-Y direction so as to correspond to all of the needles 1 to 5 only by the rotating operation of the dial 441. Thus, it is possible to carry out an accurate threading operation for all of the needles 1 to 5.

Moreover, the heights of the contact portions 351 to 355 of the lower threading guide 350 of the threading movement input mechanism 300 are set so as to individually correspond to the respective needles 1 to 5. Therefore, it is possible to adjust the threading hook 20 to be at a suitable height for the eye of each of the needles 1 to 5.

Because the two guide pins 331, 332 are provided, the respective contact portions 351 to 355 can be distributed on the lower threading guide 350. Therefore, even in a sewing machine having the five needles 1 to 5, e.g., a sewing machine which can implement overlock stitching and cover stitching, the height of the threading hook 20 can be suitably adjusted. Thus, it is possible to further improve the threading operation.

Moreover, the thread releasing mechanism 70 releases the thread from the thread holding mechanism 50 immediately after the backward movement of the threading hook 20 is started. That is, because the thread is held during the downward movement of the thread holding mechanism 50 and during the forward movement of the threading hook 20, it is possible to avoid a situation in which a threading failure is caused by a deviation of the thread from a catching position. Accordingly, it is possible to properly carry out the threading operation, thereby enhancing reliability of the mechanism.

Furthermore, the thread releasing mechanism 70 releases the thread by contacting the pinching section 53 during the upward movement of the thread releasing member 72 which is provided on the lower end part of the slide guide 320. Therefore, it is possible to simplify the movement transmitting mechanism for releasing the thread. Thus, it is possible to reduce a cost of the device and to suppress an operation failure.

In addition, the window 55*b* is provided in the body plate 55 of the pinching section 53 of the thread holding mechanism 50 to allow a visual check of the pinched thread. Therefore, it is possible to visually recognize a holding state of the thread, and to suppress a threading failure caused by an accidental slip-off of the thread or the like.

Other Embodiments

A thread releasing mechanism 70A according to another embodiment will be described with reference to FIGS. 24 to 26D.

In the thread releasing mechanism 70A, a second elastic member is provided on a rotating plate 56.

The thread releasing mechanism 70A includes an engaging member 75 which is provided on a lower end part of a slide guide 320 (an up-and-down member), a bent portion 76 which is provided integrally with an upper end part of the rotating plate 56 of a thread holding mechanism 50, and an elastic member 77 (the second elastic member) which contacts the engaging portion 75 to rotate the rotating plate 56.

The bent portion 76 is formed by bending orthogonally to a plate surface of the rotating plate 56 at the upper end part of the rotating plate 56, and is extended toward the rear in a Y-axis direction.

The elastic member 77 is screwed into the bent portion 76 so as to be extended toward the rear in the Y-axis direction. The engaging member 75 is fixed with a screw to the lower end part of the slide guide 320 so as to be extended from the slide guide 320 toward the front in the Y-axis direction. The engaging member 75 has such a length that a distal end part of the engaging member 75 contacts a distal end part of the elastic member 77 when the slide guide 320 is moved up and down.

A relationship between relative heights of the engaging member 75 and the elastic member 77 is set such that the engaging portion 75 is positioned above the elastic member 77 at the time when a threading shaft 11 is prevented from moving downward and only the slide guide 320 starts the downward movement, and such that the engaging portion 75 is positioned below the second elastic member 77 when the slide guide 320 reaches the lowermost position.

Figure 26A:
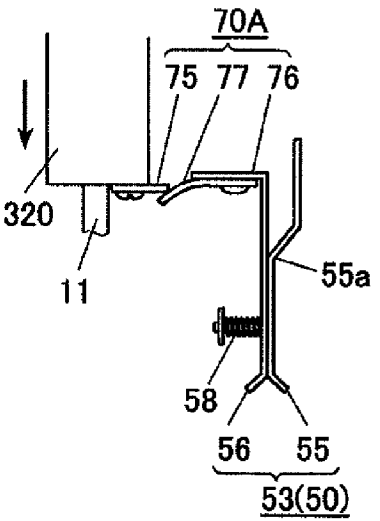
FIGS. 26A to 26D are explanatory views sequentially showing a movement of the thread releasing mechanism shown in FIG. 24.

As shown in FIG. 26A, according to the thread releasing mechanism 70A, after the simultaneous downward movement of the slide guide 320 and the threading shaft 11 is started, the engaging portion 75 contacts the elastic member 77 from above when only the slide guide 320 is moving downward.

Spring constants of the elastic member 77 and a pressing spring 58, and dimensions of a body plate 55, the rotating plate 56, the elastic member 77 and the engaging portion 75 are set such that a moment applied to the rotating plate 56 from the engaging portion 75 around a bent portion 55*a* of the body plate 55 at this time is far smaller than a moment applied to the rotating plate 56 from the pressing spring 58. Therefore, even when the engaging portion 75 contacts the elastic member 77, the rotating plate 56 maintains its orientation in contact with the body plate 55, and continuously pinches the thread.

Figure 26B:
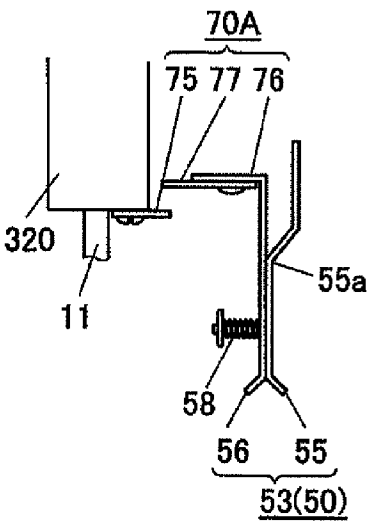

As shown in FIG. 26B, the elastic member 77 is flexed downward so that the engaging member 75 reaches a position below the elastic member 77. At this time, the threading shaft 11 is rotated by an action of a threading cam mechanism 340 so that a threading hook 20 is moved forward to penetrate through an eye of a needle to capture the thread held by the thread holding mechanism 50. Although the thread holding mechanism 50 is tilted more or less in a clockwise direction by an action of a thread holding mechanism support mechanism 60, the thread holding mechanism 50 is not illustrated in a tilted state in FIG. 26B in order to simplify an explanation of the operation. It is to be noted that the engaging member 75 has such a length that the distal end of the engaging member 75 reaches the second elastic member 77 even in a state in which the thread holding mechanism 50 is tilted.

Figure 26C:
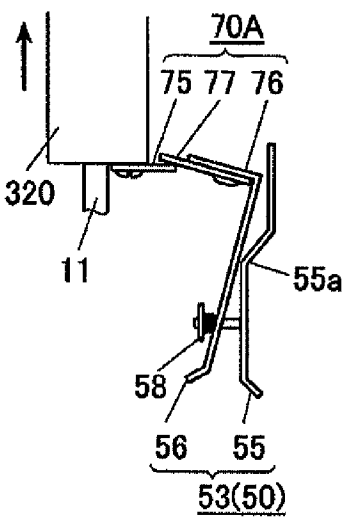
Figure 26D:
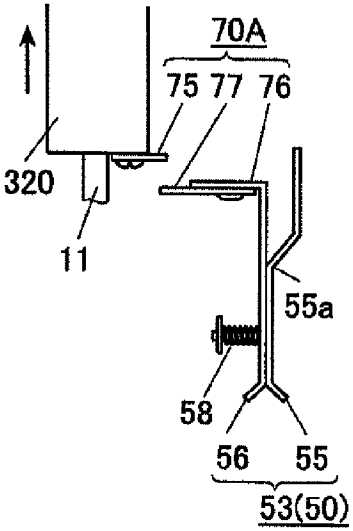
Figure 26D:
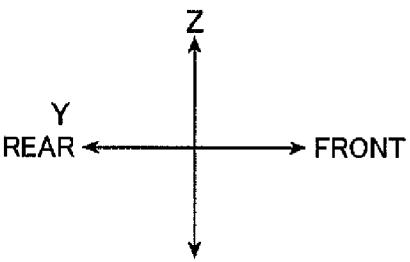
Figure 27:
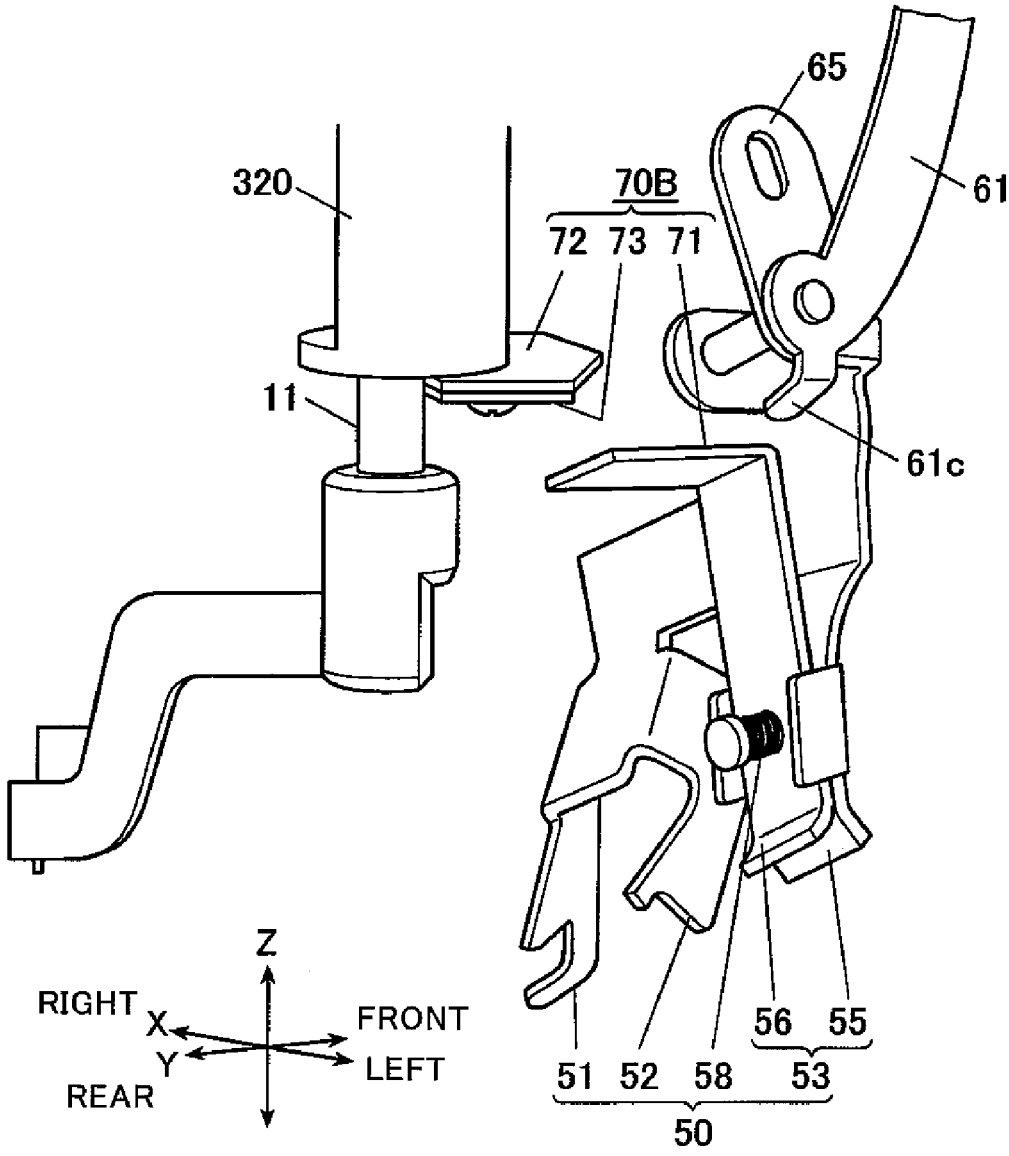
FIG. 27 is a perspective view of a thread releasing mechanism according to yet another embodiment of the present invention.
Figure 28:
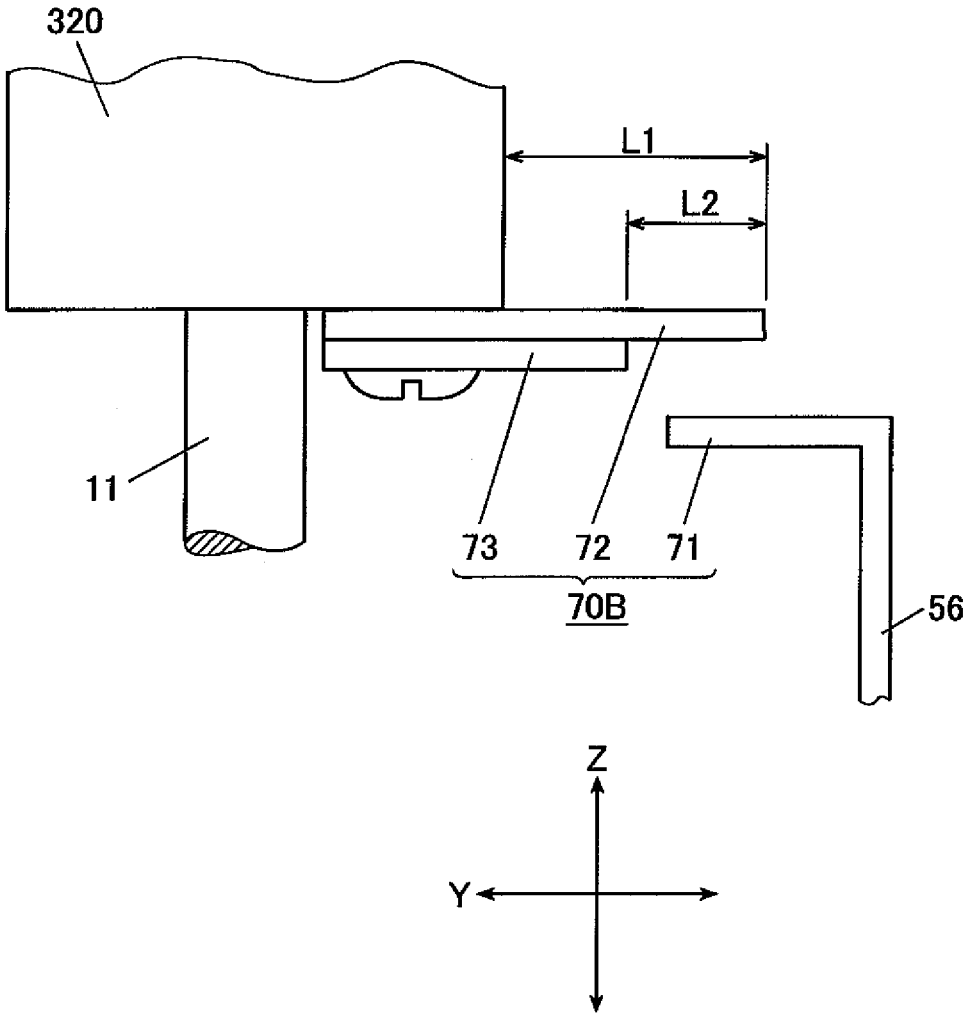
FIG. 28 is an explanatory view of the thread releasing mechanism shown in FIG. 27.

Subsequently, when the slide guide 320 starts an upward movement from a lower dead point, the threading shaft 11 is rotated in a reverse direction by the action of the threading cam mechanism 340 and the threading hook 20 is moved backward to move out of the eye of the needle so that the thread is pulled into the eye. At this time, the engaging member 75 contacts the elastic member 77 from below. The spring constants of the elastic member 77 and the pressing spring 58, and the dimensions of the body plate 55, the rotating plate 56, the bent portion 76 and the engaging member 75 are set such that the moment applied to the rotating plate 56 from the engaging member 75 around the bent portion 55*a* of the body plate 55 at this time is greater than the moment applied to the rotating plate 56 from the pressing spring 58. As shown in FIG. 26C, accordingly, when the engaging member 75 biases the elastic member 77 from below, the rotating plate 56, which is formed in a one-piece structure with the bent portion 76, rotates in the clockwise direction around the bent portion 55*a* to move away from the body plate 55 so that the thread is released. Thereafter, as shown in FIG. 26D, the engaging member 75 rotates and pushes away the rotating plate 56 to reach to a position above the second elastic member 77.

A thread releasing mechanism 70B according to still another embodiment will be described with reference to FIGS. 27 to 29D.

The thread releasing mechanism 70B includes a regulating plate 73 (a regulating member) which reduces a flexing amount of a second elastic member.

The thread releasing mechanism 70B includes an contact part 71 provided integrally with an upper end part of a rotating plate 56 of a thread holding mechanism 50, a thread releasing plate 72 (the second elastic member) which contacts the contact part 71 to rotate the rotating plate 56, and the regulating plate 73 which reduces a downward flexing amount of the thread releasing plate 72.

The contact part 71 is formed by bending orthogonally to a plate surface of the rotating plate 56 at the upper end part of the rotating plate 56, and is extended toward the rear in the Y-axis direction.

The thread releasing plate 72 and the regulating plate 73 are disposed to overlap with each other in the up-and-down direction with the regulating plate 73 placed on a lower side, and are fixed to a lower end part of a slide guide 320 with a screw so as to extend from the slide guide 320 toward the front in the Y-axis direction. The thread releasing plate 72 is extended longer than the regulating plate 73 toward the front in the Y-axis direction, and only the thread releasing plate 72 contact a distal end part of the contact part 71 when the slide guide 320 is moved up and down.

A relationship between relative heights of the thread releasing plate 72 and the contact part 71 is set such that the thread releasing plate 72 is positioned above the contact part 71 at the time when a threading shaft 11 is prevented form moving downward and only the slide guide 320 starts the downward movement and such that the thread releasing plate 72 is positioned below the contact part 71 when the slide guide 320 reaches the lowermost position.

As compared with the thread releasing plate 72, a material having a higher rigidity and less flexible is used for the regulating plate 73. The thread releasing plate 72 and the regulating plate 73 are not bonded to each other at least at free end sides thereof. That is, the thread releasing plate 72 can be flexed upward without being influenced by the regulating plate 73. However, because a lower side of a fixing end part is in contact with the regulating plate 73, a downward flexing amount is reduced.

Figure 29A:
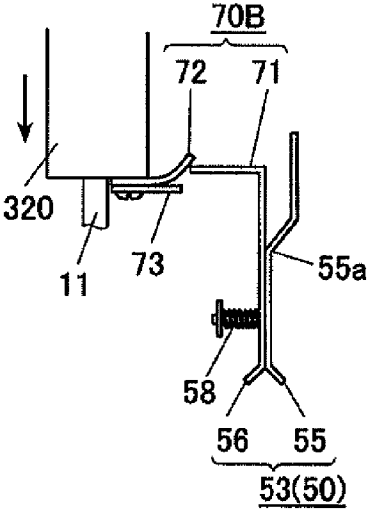
FIGS. 29A to 29D are explanatory views sequentially showing a movement of the releasing mechanism shown in FIG. 27.

As shown in FIG. 29A, after the simultaneous downward movement the slide guide 320 and the threading shaft 11 is started, the thread releasing plate 72 contacts the contact part 71 from above when only the slide guide 320 is moving downward. At this time, because the thread releasing plate 72 can be flexed upward without being influenced by the regulating plate 73, it is flexed over the entire extended length L1. Spring constants of the thread releasing plate 72 and a pressing spring 58, and dimensions of a body plate 55, the rotating plate 56 and the thread releasing plate 72 are set such that a moment applied to the rotating plate 56 from the thread releasing plate 72 around a bent portion 55*a* of the body plate 55 at this time is far smaller than a moment applied to the rotating plate 56 from the pressing spring 58. Therefore, even when the thread releasing plate 72 biases the contact part 71, the rotating plate 56 maintains its orientation in contact with the body plate 55, and continuously pinches a thread.

Figure 29B:
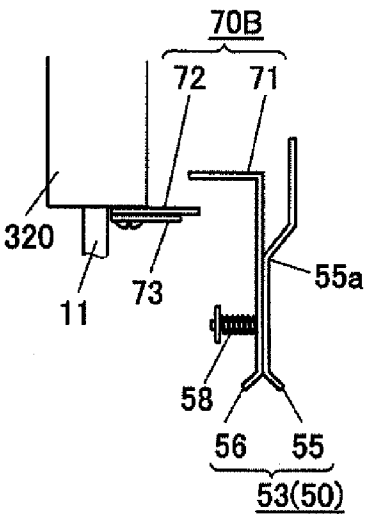

As shown in FIG. 29B, the thread releasing plate 72 is flexed upward to reach a position below the contact part 71. At this time, the threading shaft 11 is rotated by an action of a threading cam mechanism 340 so that a threading hook 20 is moved forward to penetrate through an eye of a needle to capture the thread held by the thread holding mechanism 50. Although the thread holding mechanism 50 is tilted more or less in a clockwise direction by an action of a thread holding mechanism support mechanism 60, the thread holding mechanism 50 is not illustrated in a tilted state in FIG. 29B in order to simplify an explanation of the operation. The thread releasing plate 72 has such a length that a distal end of the thread releasing plate 72 reaches the contact part 71 even in a state in which the thread holding mechanism 50 is tilted, and the regulating plate 73 has such a length that does not to reach the contact part 71.

Figure 29C:
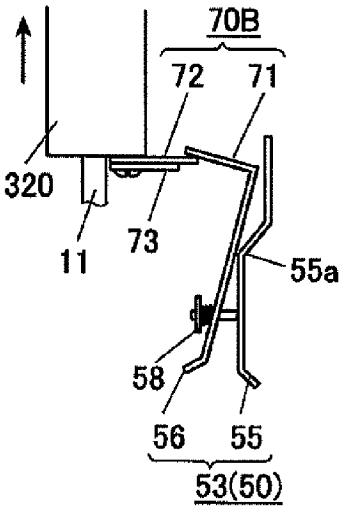
Figure 29D:
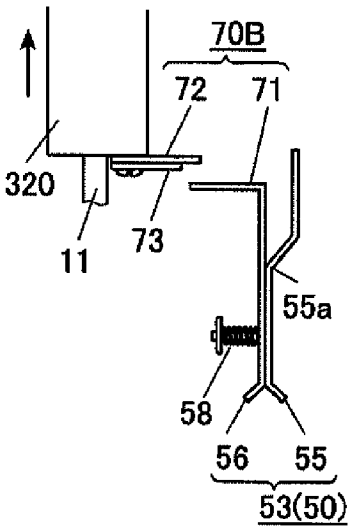
Figure 29D:
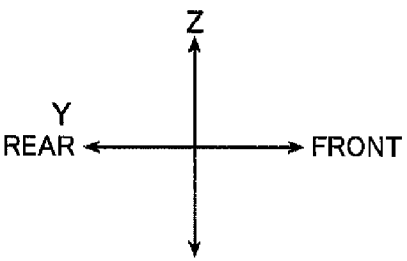

Subsequently, when an upward movement is started from a lower dead point of the slide guide 320, the threading shaft 11 is rotated in a reverse direction by the action of the threading earn mechanism 340 and the threading hook 20 is moved backward to move out of the eye of the needle so that the thread is pulled into the eye. At this time, the thread releasing plate 72 contacts the contact part 71 from below. At this time, a flexing length of the thread releasing plate 72 is limited to a length L2 by the regulating plate 73 having a high rigidity. Accordingly, the contact part 71 receives a greater upward pressing force than a downward pressing force at the time when the thread releasing plate 72 contacts from above. The spring constants of the thread releasing plate 72 and the pressing spring 58, and the dimensions of the body plate 55, the rotating plate 56, the thread releasing plate 72 and the regulating plate 73 are set such that the moment applied to the rotating plate 56 from the thread releasing plate 72 around the bent portion 55*a* of the body plate 55 is greater than the moment applied to the rotating plate 56 from the pressing spring 58. As shown in FIG. 29C, accordingly, when the thread releasing plate 72 biases the contact part 71, the rotating plate 56, which is formed in a one-piece structure with the contact part 71, rotates in the clockwise direction around the bent portion 55*a* to move away from the body plate 55 so that the thread is released. Thereafter, as shown in FIG. 29D, the thread releasing plate 72 rotates and pushes away the contact part 71 to reaches a portion above the contact part 71.

According to the configuration described above, the regulating plate 73 reduces the flexing amount of the thread releasing plate 72 during the upward movement of the slide guide 320 as compared with the case in which the slide guide 320 is moving downward. Therefore, a force for biasing the rotating plate 56 with the thread releasing plate 72 is increased. Consequently, the force for biasing the rotating plate 56 with the thread releasing plate 72 can be reliably made greater than the force of the pressing spring 58 for biasing the rotating plate 56 in a thread pinching direction. Thus, it is possible to reliably release the thread in the upward movement of the slide guide 320.

According to the thread releasing mechanisms 70, 70A, 70B described above, the thread is released after the threading hook 20 captures the thread. Therefore, the thread is always within a moving path of the threading hook 20 when capturing the thread with the threading hook 20, so that the threading hook can reliably capture the thread. Moreover, it is possible to simplify an operation transmitting structure, so that the threading device becomes less expensive and an operation failure can be suppressed.

The thread releasing mechanisms 70, 70A, 70B and the thread holding mechanism 50 described above may be applied, not only to the threading device 10 described above, but also to a threading device used in a sewing machine which has a smaller number of needles (e.g., one or two).

Moreover, the configuration of the pinching section 53 of the thread holding mechanism 50 is not limited to the foregoing, and the rotating plate 56 may be rotatable with respect to the body plate 55 via a hinge or the like. Furthermore, the pinching section 53 is not limited to the rotating structure, and a member which is slidable with respect to the body plate 55 may be used instead of the rotating plate 56.

For example, it may be configured such that a body plate and a slide plate are disposed to face each other so as to be able to pinch a thread, and such that a lower end part of the slide plate is slid upward that a lower end of each side wall portion 55*a* in a releasing operation to release the thread. The thread releasing mechanisms 70, 70A, 70B can be combined with a thread holding mechanism having such a configuration.

Figure 30:
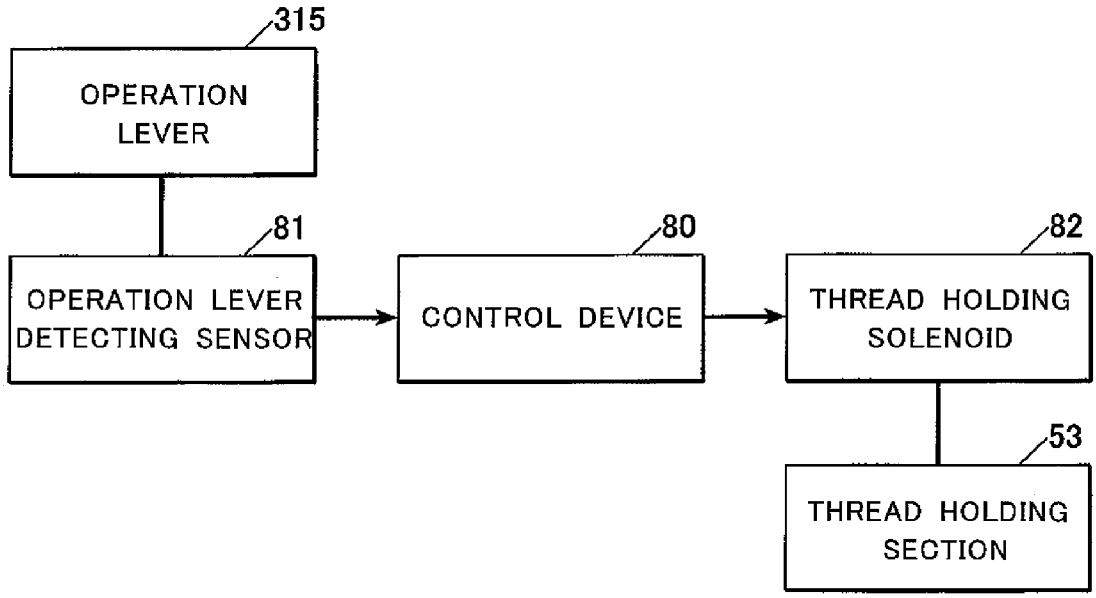
FIG. 30 is a block diagram of a threading device according to yet anther embodiment of the present invention.

Further, as shown in FIG. 30, a pinching operation of the pinching section 53 of the thread holding mechanism 50 may be implemented by using an actuator such as a thread holding solenoid 82, and a sensor 81 which detects a position of an operation lever 315 may be provided, so that a control device 80 executes a control for releasing the thread held by the thread holding solenoid 82 when the operation lever 315 comes to a certain position. In this case, because the operation lever 315 passes the same position twice, namely, during its downward movement and its upward movements, the sensor 81, the solenoid 82 may be controlled to be actuated upon the second detection by the sensor 81.

Furthermore, the sensor 81 is not limited detect the position of the operation lever 315, and may be any sensor which detects a backward movement of the threading hook 20.

By providing these control systems, it is possible to obtain the same advantages as those in the threading device 10 and to simplify a mechanical structure. Therefore, it is possible to enhance a reliability of an operation. In addition, a timing for releasing the thread can be adjusted only by changing a setting of a control. Thus, it is possible to carry out a more favorable thread releasing control.

While the present invention has been described with reference to certain embodiments thereof, it will be understood by those skilled in the art that various changes and modifications may be made therein without departing from the spirit and scope of the present invention as defined by the appended claims.

What is claimed is:

1. A threading device of a sewing machine, the threading device comprising:

a threading hook which moves forward to penetrate through an eye of a needle to capture a thread and which moves backward to insert the thread into the eye;

a threading shaft which holds the threading hook at a lower end thereof;

a threading movement input mechanism from which an operation for causing the threading hook to carry out a threading movement is input;

an up-and-down member which moves, in accordance with the operation to the threading movement input mechanism, in up and down directions to rotate the threading shaft;

a thread holding mechanism which holds the thread to be inserted into the needle by pinching the thread with a pinching section which is biased by a first elastic member; and a thread releasing mechanism which releases the thread that is held by the thread holding mechanism, wherein the thread releasing mechanism releases the thread when the threading hook is moving backward.

2. The threading device according to claim 1, wherein the thread releasing mechanism comprises a second elastic member which is attached to the up-and-down member and which engages with the pinching section when the up-and-down member is moving in the up and down directions, wherein, when the up-and-down member is moving downward, the second elastic member engages with the pinching section in a direction in which the thread is not released, and when the up-and-down member is moving upward, the second elastic member biases the pinching section in a direction in which the thread is released.

3. The threading device according to claim 1, wherein the thread releasing mechanism comprises an engaging member provided on the up-and-down member; and a second elastic member attached to the pinching member so as to engage with the engaging member when the up-and-down member is moving in the up and down directions, wherein, when the up-and-down member is moving downward, the second elastic member engages with the engaging member so as not to release the thread, and when the up-and-down member is moving upward, the second elastic member engages with the engaging member and biases the pinching section in a direction in which the thread is released.

4. The threading device according to claim 2, further comprising a regulating member which reduces a flexing amount of the second elastic member.

5. The threading device according to claim 1, wherein the pinching section comprises two pinching members facing each other, and at least one of the pinching members is formed with a window through which the thread held by the two pinching members is visually recognizable.

6. A threading device of a sewing machine, the threading device comprising:

a threading hook which moves forward to penetrate through an eye of a needle to capture a thread and which moves backward to insert the thread into the eye;

thread holding means for holding the thread such that the thread extends in front of the eye of the needle; and thread releasing means for releasing, when the threading hook is moving backward, the thread that is held by the thread holding means.

* * * * *